US010105962B2

(12) United States Patent
Ueda

(10) Patent No.: US 10,105,962 B2
(45) Date of Patent: Oct. 23, 2018

(54) LIQUID EJECTION APPARATUS

(71) Applicant: BROTHER KOGYO KABUSHIKI KAISHA, Nagoya-shi, Aichi-ken (JP)

(72) Inventor: Toshiro Ueda, Kiyosu (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/708,602

(22) Filed: Sep. 19, 2017

(65) Prior Publication Data

US 2018/0178542 A1 Jun. 28, 2018

(30) Foreign Application Priority Data

Dec. 27, 2016 (JP) ..... 2016-253481

(51) Int. Cl.
*B41J 2/19* (2006.01)
*B41J 2/165* (2006.01)
*B41J 2/195* (2006.01)

(52) U.S. Cl.
CPC ..... *B41J 2/195* (2013.01); *B41J 2/16517* (2013.01); *B41J 2/19* (2013.01); *B41J 2002/16573* (2013.01)

(58) Field of Classification Search
CPC . B41J 2/195; B41J 2/19; B41J 2/16517; B41J 2002/16573
See application file for complete search history.

(56) References Cited

U.S. PATENT DOCUMENTS 5,781,204 A 7/1998 Kanematsu et al.
2006/0268076 A1 11/2006 Kaga

FOREIGN PATENT DOCUMENTS

JP H08-39833 A 2/1996
JP 2007-001300 A 1/2007
JP 2007-136832 A 6/2007
JP 2007-152579 A 6/2007
JP 2008-087217 A 4/2008

*Primary Examiner* — Julian Huffman
(74) *Attorney, Agent, or Firm* — Scully, Scott, Murphy & Presser, P.C.

(57) ABSTRACT

A liquid ejection apparatus includes: a head; a first-liquid-passage member defining a first liquid passage as a portion of a liquid passage connecting between the head and a tank; a second-liquid-passage member, as another portion of the liquid passage, defining a second liquid passage and having a gas permeability less than the first-liquid-passage member; a purging device; and a controller configured to: obtain air-position information relating to a position of air having flowed into the liquid passage from a liquid inlet opening; and execute a liquid discharge processing in which the controller controls the purging device to execute a liquid purging operation such that an amount of the liquid discharged when the air position indicated by the air-position information is located in the second liquid passage is less than that of the liquid discharged when the air position is located in the first liquid passage.

18 Claims, 11 Drawing Sheets

LIQUID EJECTION APPARATUS

CROSS REFERENCE TO RELATED APPLICATION

The present application claims priority from Japanese Patent Application No. 2016-253481, which was filed on Dec. 27, 2016, the disclosure of which is herein incorporated by reference in its entirety.

BACKGROUND

The following disclosure relates to a liquid ejection apparatus.

There is known an ink-jet printer, as one example of a liquid ejection apparatus, including a printing head, a removable ink tank configured to store ink to be supplied to the printing head, and a recovery mechanism configured to perform purging for recovering performance of ink ejection by the printing head. In this ink-jet printer, when a time elapsed from the preceding purging exceeds a particular time, the purging is performed automatically.

SUMMARY

The above-described ink-jet printer has ink passages extending from the ink tank to the printing head. Air flows into the ink passages when the ink tank is mounted and removed, for example. Performance of ink ejection by the printing head may be deteriorated in case where the air having flowed into the ink passages enters the printing head. In this case, the degree of the deterioration of the performance of ink ejection by the printing head increases with increase in the volume of the air. In addition, a consumption of the ink used when the air is discharged from the ink passages to the outside increases with increase in the volume of the air.

Air remaining in the ink passage increases in size with time by penetration of atmosphere through an outer wall of a liquid-passage defining member defining the ink passage. Here, the ink passages may include: a liquid passage defined by a liquid-passage defining member having high gas permeability; and a liquid passage defined by a liquid-passage defining member having low gas permeability. In this case, the degree of increase in size of the air increases with increase in the gas permeability of the liquid-passage defining member defining the liquid passage in which the air is located. Accordingly, different lengths of time for which the air remains in each position in the ink passages lead to different volumes of the air flowing into the printing head.

In the above-described ink-jet printer, the purging for discharging the same amount of the ink is performed at regular intervals regardless of a position at which the air exists in the ink passages. In the case where the amount of the ink discharged in each purging is small, the air may remain for a long time in the liquid passage defined by the liquid-passage defining member having high gas permeability. In this case, the size of the air may increase greatly, which may result in a large volume of the air flowing into the printing head. In the case where the amount of the ink discharged in each purging is large, a large amount of the ink is unnecessarily consumed in each purging.

Accordingly, an aspect of the disclosure relates to a liquid ejection apparatus configured to consume a smaller amount of the liquid while reducing increase in size of air existing in a liquid passage.

In one aspect of the disclosure, a liquid ejection apparatus includes: a head having a plurality of nozzles, the head being configured to eject liquid through the plurality of nozzles; a first-liquid-passage member defining a first liquid passage that is a portion of a liquid passage connecting the head and a tank to each other, the tank being configured to store the liquid; a second-liquid-passage member defining a second liquid passage that is another portion of the liquid passage which is different from the portion of the liquid passage as the first liquid passage, a gas permeability of the second-liquid-passage member being less than that of the first-liquid-passage member; a purging device configured to perform a liquid purging operation to forcibly discharge the liquid from the plurality of nozzles; and a controller configured to: obtain air-position information as positional information relating to a position of air having flowed into the liquid passage from a liquid inlet opening that is one end of the liquid passage which is nearer to the tank than another end of the liquid passage; and execute a liquid discharge processing in which the controller controls the purging device to execute the liquid purging operation such that an amount of the liquid discharged in the liquid purging operation performed when the position of the air which is indicated by the air-position information is located in the second liquid passage is less than an amount of the liquid discharged in the liquid purging operation performed when the position of the air which is indicated by the air-position information is located in the first liquid passage.

In another aspect of the disclosure, a liquid ejection apparatus includes: a head having a plurality of nozzles, the head being configured to eject liquid through the plurality of nozzles; a liquid passage definer defining (a) a liquid passage connecting between the head and a tank configured to store the liquid and (b) an air-discharge passage extending to an outside by branching off from a branch position located at a portion of the liquid passage, the liquid passage definer including (i) a first-liquid-passage member defining a first liquid passage that is a portion of the liquid passage and that is located nearer to the tank than the branch position and (ii) a second-liquid-passage member defining a second liquid passage that is located nearer to the tank than the branch position and that is another portion of the liquid passage which is different from the portion of the liquid passage as the first liquid passage, a gas permeability of the second-liquid-passage member being less than that of the first-liquid-passage member; a purging device configured to perform an air-discharge purging operation to discharge air from the liquid passage to the outside via the air-discharge passage; and a controller configured to: obtain air-position information as positional information relating to a position of the air having flowed into the liquid passage from a liquid inlet opening that is one end of the liquid passage which is nearer to the tank than another end of the liquid passage; and execute a liquid discharge processing in which the controller controls the purging device to execute the air-discharge purging operation such that an amount of the air discharged from the liquid passage in the air-discharge purging operation performed when the position of the air which is indicated by the air-position information is located in the second liquid passage is less than an amount of the air discharged from the liquid passage in the air-discharge purging operation performed when the position of the air which is indicated by the air-position information is located in the first liquid passage.

In still another aspect of the disclosure, a liquid ejection apparatus includes: a head having a plurality of nozzles, the head being configured to eject liquid through the plurality of nozzles; a first-liquid-passage member defining a first liquid passage that is a portion of a liquid passage connecting the head and a tank to each other, the tank being configured to store the liquid; a second-liquid-passage member defining a second liquid passage that is another portion of the liquid passage which is different from the portion of the liquid passage as the first liquid passage, a gas permeability of the second-liquid-passage member being less than that of the first-liquid-passage member; a purging device configured to perform a liquid purging operation to forcibly discharge the liquid from the plurality of nozzles; and a controller configured to: obtain air-position information as positional information relating to a position of air having flowed into the liquid passage from a liquid inlet opening that is one end of the liquid passage which is nearer to the tank than another end of the liquid passage; and execute a liquid discharge processing in which the controller controls the purging device to execute the liquid purging operation such that an interval at which the liquid purging operation is performed when the position of the air which is indicated by the air-position information is located in the second liquid passage is greater than an interval at which the liquid purging operation is performed when the position of the air which is indicated by the air-position information is located in the first liquid passage.

In still another aspect of the disclosure, a liquid ejection apparatus includes: a head having a plurality of nozzles, the head being configured to eject liquid through the plurality of nozzles; a liquid passage definer defining (a) a liquid passage connecting between the head and a tank configured to store the liquid and (b) an air-discharge passage extending to an outside by branching off from a branch position located at a portion of the liquid passage, the liquid passage definer including (i) a first-liquid-passage member defining a first liquid passage that is a portion of the liquid passage and that is located nearer to the tank than the branch position and (ii) a second-liquid-passage member defining a second liquid passage that is located nearer to the tank than the branch position and that is another portion of the liquid passage which is different from the portion of the liquid passage as the first liquid passage, a gas permeability of the second-liquid-passage member being less than that of the first-liquid-passage member; a purging device configured to perform an air-discharge purging operation to discharge air from the liquid passage to the outside via the air-discharge passage; and a controller configured to: obtain air-position information as positional information relating to a position of the air having flowed into the liquid passage from a liquid inlet opening that is one end of the liquid passage which is nearer to the tank than another end of the liquid passage; and execute a liquid discharge processing in which the controller controls the purging device to execute the air-discharge purging operation such that an interval at which the air-discharge purging operation is performed when the position of the air which is indicated by the air-position information is located in the second liquid passage is greater than an interval at which the air-discharge purging operation is performed when the position of the air which is indicated by the air-position information is located in the first liquid passage.

In still another aspect of the disclosure, a liquid ejection apparatus includes: a head having a plurality of nozzles, the head being configured to eject liquid through the plurality of nozzles; a first-liquid-passage member defining a first liquid passage that is a portion of a liquid passage connecting the head and a tank to each other, the tank being configured to store the liquid; a second-liquid-passage member defining a second liquid passage that is another portion of the liquid passage which is different from the portion of the liquid passage as the first liquid passage, a gas permeability of the second-liquid-passage member being less than that of the first-liquid-passage member; and a controller configured to: control the head to perform a flushing operation to discharge the liquid from the plurality of nozzles; obtain air-position information as positional information relating to a position of air having flowed into the liquid passage from a liquid inlet opening that is one end of the liquid passage which is nearer to the tank than another end of the liquid passage; and set an amount of the liquid discharged in the flushing operation performed when the position of the air which is indicated by the air-position information is located in the second liquid passage, to value less than an amount of the liquid discharged in the flushing operation performed when the position of the air which is indicated by the air-position information is located in the first liquid passage.

BRIEF DESCRIPTION OF THE DRAWINGS

The objects, features, advantages, and technical and industrial significance of the present disclosure will be better understood by reading the following detailed description of the embodiments, when considered in connection with the accompanying drawings, in which.

DETAILED DESCRIPTION OF THE EMBODIMENTS

Hereinafter, there will be described embodiments by reference to the drawings.

First Embodiment

Figure 1:
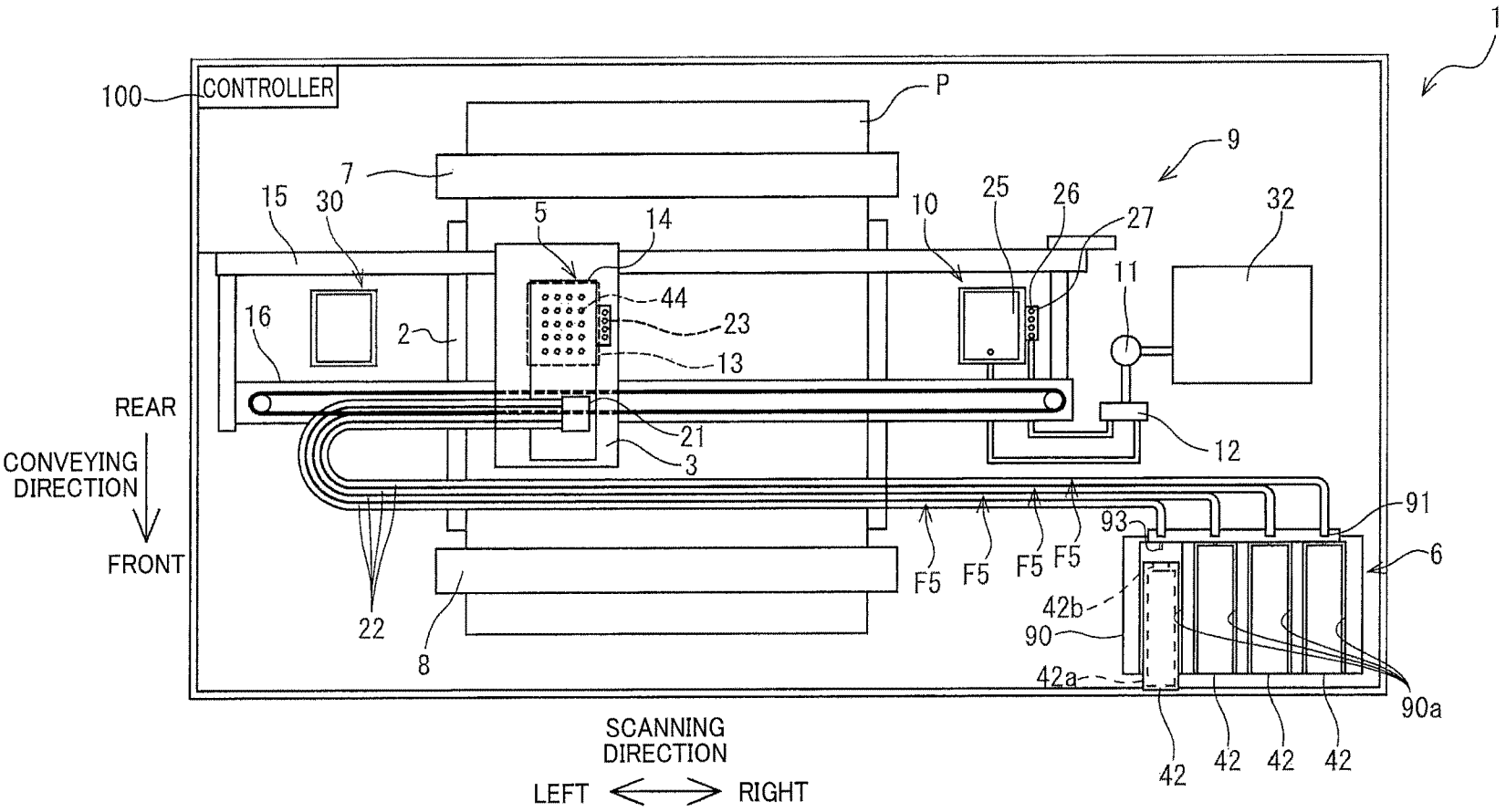
FIG. 1 is a schematic view of an ink-jet printer according to a first embodiment.

First, there will be described an overall configuration of an ink-jet printer 1 according to a first embodiment. As illustrated in FIG. 1, the printer 1 includes a platen 2, a carriage 3, a head unit 5, a cartridge holder 6, a sheet-supply roller 7, a sheet-discharge roller 8, a purging device 9, a flushing receiver 30, a touch screen 99 (see FIG. 4), and a controller 100. In the following description, the front side of the sheet illustrating FIG. 1 is defined as an upper side of the printer 1, and the back side of the sheet illustrating FIG. 1 is defined as a lower side of the printer 1. The other sides of the printer 1 are defined with respect to these sides. Also, the front and rear direction and the right and left direction indicated in FIG. 1 are respectively defined as a front and rear direction and a right and left direction in the printer 1. The other directions in the printer 1 are defined with respect to these directions.

An upper surface of the platen 2 supports a sheet P as a recording medium. Two guide rails 15, 16 each extending in a direction parallel with the right and left direction (i.e., a scanning direction) are provided over the platen 2. The carriage 3 is mounted on the guide rails 15, 16. When a carriage driving motor 20 (see FIG. 4) is driven, the carriage 3 is moved in the scanning direction along the guide rails 15, 16 at a region opposed to the platen 2.

Ink cartridges 42 for storing ink of four colors, namely, black, yellow, cyan, and magenta, are removably mounted on the cartridge holder 6. Each of the ink cartridges 42 includes: a storage chamber 42*a* for storing the ink; an outlet pipe 42*b* connected to the storage chamber 42*a*; and an atmosphere communicating liquid passage, not illustrated, that establishes communication between the storage chamber 42*a* and an atmosphere. The outlet pipe 42*b* defines a liquid passage for transferring the ink from the storage chamber 42*a* to an outside of the ink cartridge 42.

The cartridge holder 6 includes a casing 90 and a resin member 91. The casing 90 has a substantially rectangular parallelepiped shape and has an opening in a front surface of the casing 90. The casing 90 is provided with four mount portions 90*a* arranged in the right and left direction. The four ink cartridges 42 are mountable on the respective mount portions 90*a*.

Figure 3:
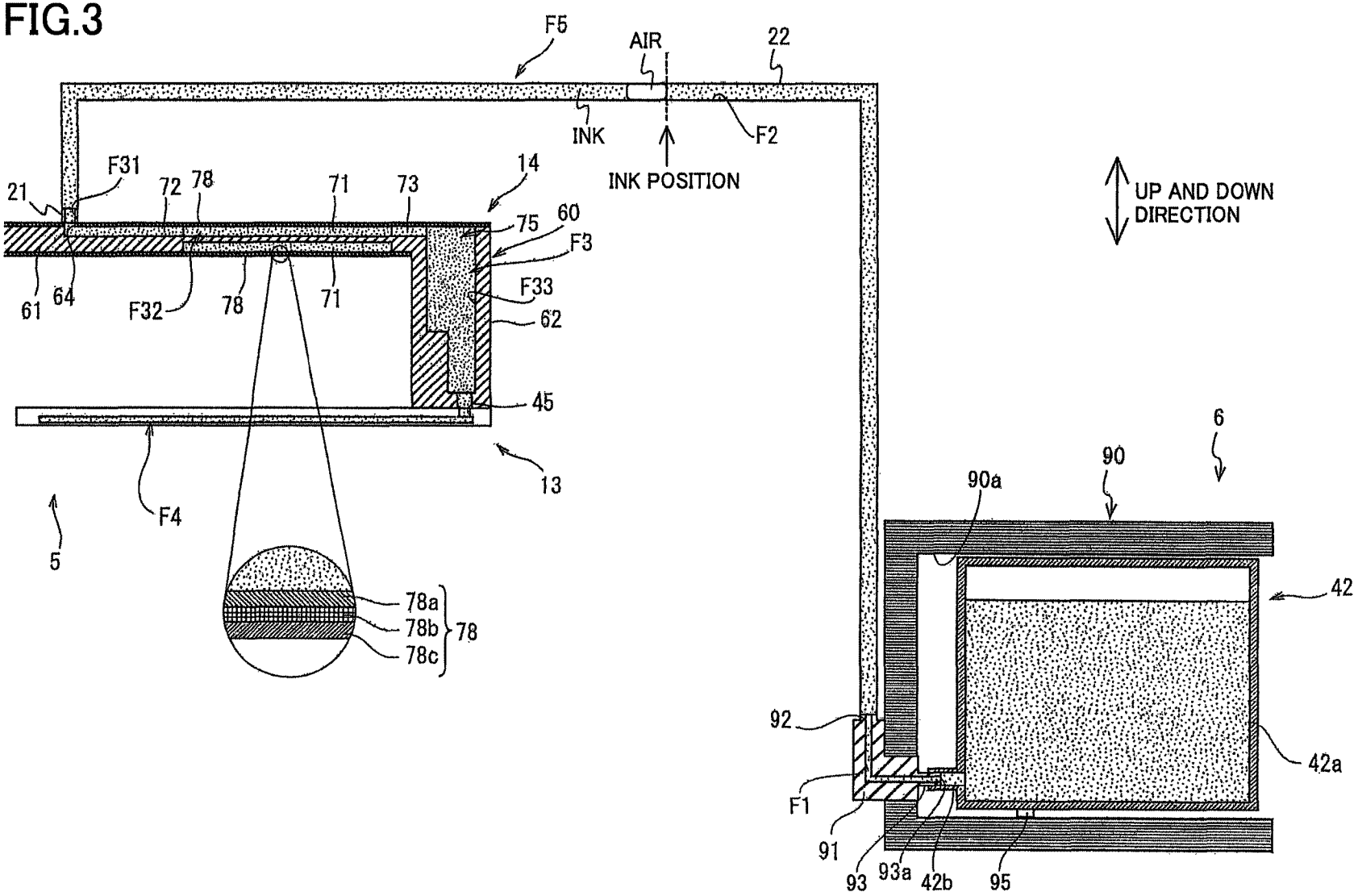
FIG. 3 is a schematic vertically-cross-sectional view of the head unit, an ink cartridge, and a cartridge holder.

The resin member 91 is formed of resin such as polypropylene. As illustrated in FIG. 3, the resin member 91 is formed with four joints 92 and four needles 93. The four joints 92 correspond to the respective four colors of the ink. Likewise, the four needles 93 correspond to the respective four colors of the ink. The joints 92 are formed on an upper surface of the resin member 91. Ink-supply tubes 22 are connected to the respective joints 92. Specifically, one end of each of the ink-supply tubes 22 is removably connected to a corresponding one of the joints 92, while the other end of each of the ink-supply tubes 22 is connected to the head unit 5. Each of the ink-supply tubes 22 is a flexible tube that defines therein a tube liquid passage F2. As will be described below, the head unit 5 to which the ink-supply tubes 22 are connected is mounted on the carriage 3 reciprocable in the scanning direction. Thus, each of the ink-supply tubes 22 needs to have low stiffness so as to avoid hindrance to movement of the carriage 3 as much as possible. In the present embodiment, the ink-supply tube 22 is a single-layer tube formed of synthetic resin. It is noted that the following description is provided for one of the four colors of the ink for simplicity unless otherwise required by context.

The needle 93 protrudes frontward from a front surface of the resin member 91. The resin member 91 defines therein an internal passage F1 that connects the needle 93 and the joint 92 to each other. An ink inlet opening 93*a* communicating with the internal passage F1 is formed in an outer circumferential surface of the needle 93. When the ink cartridge 42 is mounted on the mount portion 90*a*, the needle 93 is connected to the outlet pipe 42*b* of the ink cartridge 42, whereby the ink in the storage chamber 42*a* flows from the ink inlet opening 93*a* into the internal passage F1. As a result, the ink in the storage chamber 42*a* of the ink cartridge 42 is supplied from the ink inlet opening 93*a* of the needle 93 to the head unit 5 via the internal passage F1 and the tube liquid passage F2. The cartridge holder 6 is provided with sensors 95 each configured to detect whether a corresponding one of the ink cartridges 42 is mounted on the cartridge holder 6.

Returning to FIG. 1, the head unit 5 is mounted on a lower portion of the carriage 3, with a space between the head unit 5 and the platen 2. The head unit 5 is movable with the carriage 3 not only over an opposite region opposed to the sheet P conveyed over the platen 2 but also over regions respectively located to the right and the left of the opposite region. The purging device 9 is disposed to the right of the opposite region, while the flushing receiver 30 is disposed to the left of the opposite region.

Figure 2:
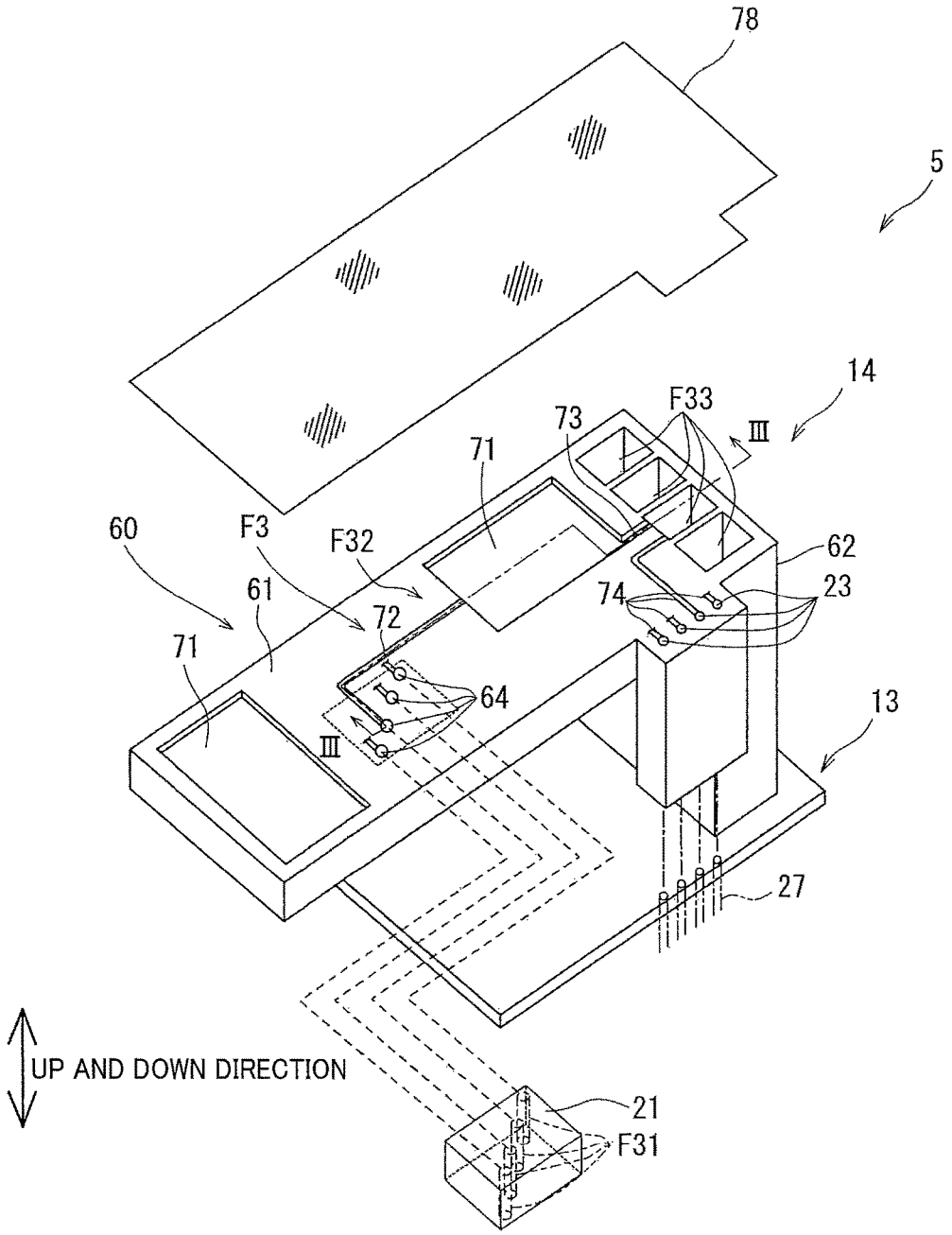
FIG. 2 is a perspective view of a head unit.

As illustrated in FIGS. 1 and 2, the head unit 5 includes a head 13 and a sub-tank 14 provided on an upper surface of the head 13. A lower surface of the head 13 is an ejection surface having a multiplicity of nozzles 44 from which the ink is ejected. The nozzles 44 are arranged in four rows in a direction (i.e., a conveying direction in which the sheet P is conveyed) orthogonal to the scanning direction. The ink of each of the four colors is ejected from the nozzles 44 forming a corresponding one of the four nozzle rows. As illustrated in FIG. 3, the head 13 defines therein head liquid passages F4 that connect the sub-tank 14 and the nozzles 44 to each other. It is noted that FIG. 3 illustrates the sub-tank 14 as a vertically-cross-sectional view taken along line in FIG. 2 but illustrates the head 13 not as a cross-sectional view but as a side view.

The sub-tank 14 temporarily stores the ink to be supplied to the head 13. A joint 21 is formed on an upper surface of the sub-tank 14. The ink-supply tube 22 is removably connected to the joint 21. The sub-tank 14 defines therein supply liquid passages F3 each connecting the joint 21 and a corresponding one of the head liquid passages F4 to each other.

As illustrated in FIG. 2, the sub-tank 14 is provided with four air-discharge portions 23 corresponding to the respective four colors of the ink. The air-discharge portions 23 are for discharging air from the supply liquid passages F3 before the air moves to the head 13. Valves, not illustrated, are provided in the respective four air-discharge portions 23. Each of the valves switches whether a corresponding one of the air-discharge portions 23 communicates with or is isolated from the outside. The head 13 and the sub-tank 14 will be described later in detail.

The sheet-supply roller 7 and the sheet-discharge roller 8 are rotated by a conveying motor 29 (see FIG. 4) in synchronization with each other. The sheet-supply roller 7 and the sheet-discharge roller 8 are cooperated to convey the sheet P in the conveying direction over the platen 2. The printer 1 controls the sheet-supply roller 7 and the sheet-discharge roller 8 to convey the sheet P in the conveying direction and at the same time controls the head unit 5 to eject the ink from the nozzles 44 while moving the head unit 5 in the scanning direction with the carriage 3, so that a desired image is printed on the sheet P. That is, the printer 1 according to the present embodiment is a serial ink-jet printer.

The purging device 9 performs maintenance for maintaining and recovering performance of ejection of the head 13. As illustrated in FIG. 1, the purging device 9 includes a cap unit 10, a suction pump 11, and a switching device 12. The cap unit 10 is opposed to the head unit 5 in the up and down direction when the head unit 5 is moved to a position located to the right of the opposite region opposed to the sheet P conveyed over the platen 2. The cap unit 10 is driven by a cap driving motor 24 (see FIG. 4) and thereby movable in the up and down direction. This cap unit 10 includes a nozzle cap 25 and an air-discharge cap 26.

In the state in which the head unit 5 is opposed to the cap unit 10, the nozzle cap 25 faces the lower surface of the head 13, and the air-discharge cap 26 faces lower surfaces of the respective four air-discharge portions 23 provided on the sub-tank 14. When the cap unit 10 is moved upward in the state in which the head unit 5 and the cap unit 10 are opposed to each other, the cap unit 10 is mounted on the head 13 and the sub-tank 14. As a result, the nozzle cap 25 covers all the nozzles 44 in the four nozzle rows, and the air-discharge cap 26 is connected to the four air-discharge portions 23. The air-discharge cap 26 is provided with four opening and closing members 27, each of which is shaped like a rod to open and close the valve in a corresponding one of the four air-discharge portions 23. In the state in which the air-discharge cap 26 is connected to the four air-discharge portions 23, the four opening and closing members 27 are driven and moved upward and downward by an air-discharge motor 28 (see FIG. 4). When the four opening and closing member 27 is moved upward and inserted into the air-discharge portion 23, the valve therein is moved.

The nozzle cap 25 and the air-discharge cap 26 are connected to the suction pump 11 via the switching device 12. The switching device 12 switches a destination of communication of the suction pump 11 selectively to one of the nozzle cap 25 and the air-discharge cap 26. By the switching of the switching device 12, the printer 1 selectively performs one of (i) suction purging for forcibly discharging the ink from all the nozzles 44 in the four nozzle rows and (ii) air-discharge purging for discharging air from the supply liquid passages F3 defined in the sub-tank 14 (i.e., air from air storage chambers 75 which will be described below).

In the suction purging, the switching device 12 first establishes the communication between the suction pump 11 and the nozzle cap 25 in the state in which the nozzle cap 25 is mounted on the head 13 so as to cover the nozzles 44. The suction pump 11 is driven in this state to reduce pressure in the nozzle cap 25 (to perform suctioning from the nozzle cap 25), thereby sucking the ink from each of the nozzles 44 formed in the head 13. As a result, foreign matters, air bubbles, the ink having a viscosity increased by drying, and so on are discharged from the head 13 through the nozzles 44 to recover the performance of the ink ejection of the head 13.

In the air-discharge purging, the air-discharge cap 26 is connected to the air-discharge portions 23, and the switching device 12 establishes the communication between the suction pump 11 and the air-discharge cap 26 in a state in which the valves provided in the air-discharge portions 23 are opened by the respective opening and closing members 27. The suction pump 11 is driven in this state to apply negative pressure to the air-discharge portions 23. This negative pressure causes the air in the supply liquid passages F3 defined in the sub-tank 14 to be discharged into the air-discharge cap 26 before flowing into the head 13, making it possible to reduce deterioration of the performance of the ink ejection of the head 13. In the air-discharge purging, some amount of the ink in the supply liquid passages F3 is discharged into the air-discharge cap 26 with air. The ink discharged from the head unit 5 by the suction purging and the air-discharge purging is transferred to a waste-liquid tank 32 connected to the suction pump 11.

The flushing receiver 30 is disposed to the left of the opposite region opposed to the sheet P conveyed over the platen 2. The head unit 5 ejects the ink from each of the nozzles 44 in a state in which the head unit 5 is opposed to the flushing receiver 30, thereby discharging the ink having a viscosity increased in the nozzles 44. In the following description, the above-described ink ejection for reducing the increase in viscosity of the ink is referred to as "flushing".

Figure 4:
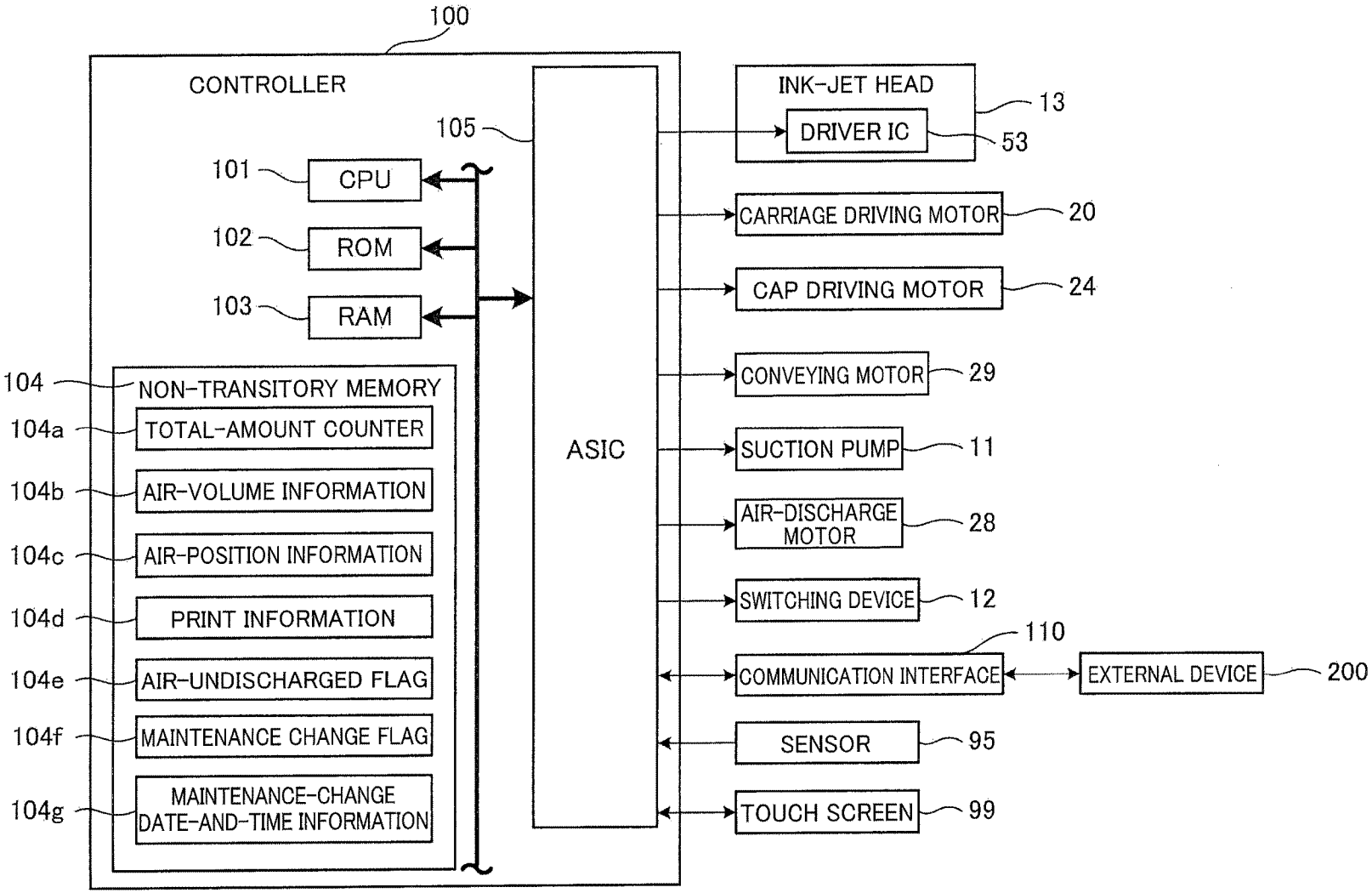
FIG. 4 is a block diagram schematically illustrating an electric configuration of the ink-jet printer.

As illustrated in FIG. 4, the controller 100 includes a central processing unit (CPU) 101, a read only memory (ROM) 102, a random access memory (RAM) 103, a non-transitory memory 104, and an application-specific integrated circuit (ASIC) 105 including various control circuits. Devices electrically connected to the ASIC 105 include the head 13, the suction pump 11, the switching device 12, the touch screen 99, and a communication interface 110.

The ROM 102 stores information including programs executable by the CPU 101 and various kinds of fixed data. The RAM 103 temporarily stores data, such as image data, required for the CPU 102 to execute the programs. The non-transitory memory 104 stores various kinds of information. The various kinds of information stored in the non-transitory memory 104 will be described below.

The CPU 101 executes the programs stored in the ROM 102 to execute, via the ASIC 105, various processings for controlling operations of the devices including the head 13 and the purging device 9. While the following description is provided assuming that the CPU executes the various processings, the controller 100 may include a plurality of CPUs which share execution of the processings. Also, the controller 100 may include a plurality of ASICs which share execution of the processings. Alternatively, a single ASIC may execute the processings solely. The various processings executed by the CPU 101 will be described below.

There will be next described specific configurations of the head 13 and the sub-tank 14 with reference to FIGS. 2, 3, and 5A-5C.

Figure 5A:
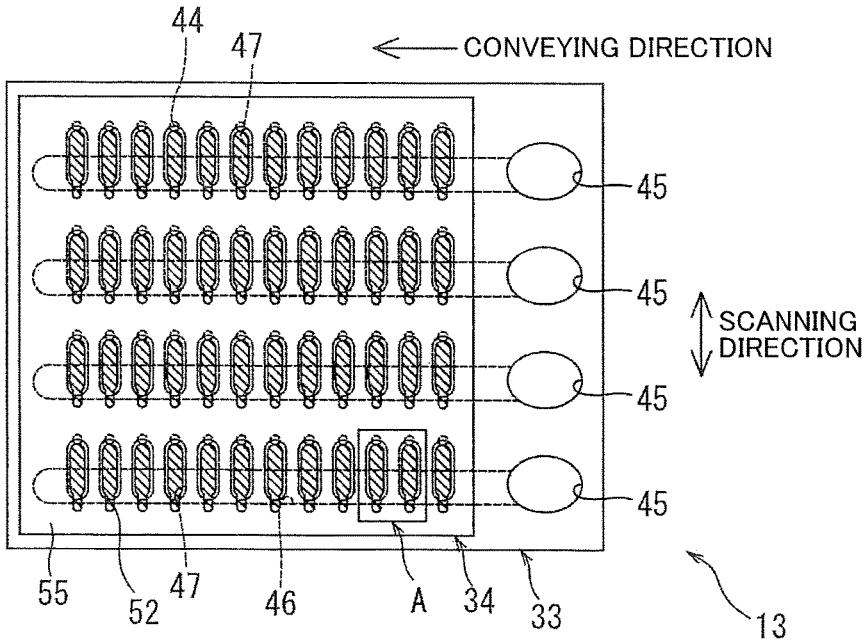
FIG. 5A is a plan view of the head.
Figure 5B:
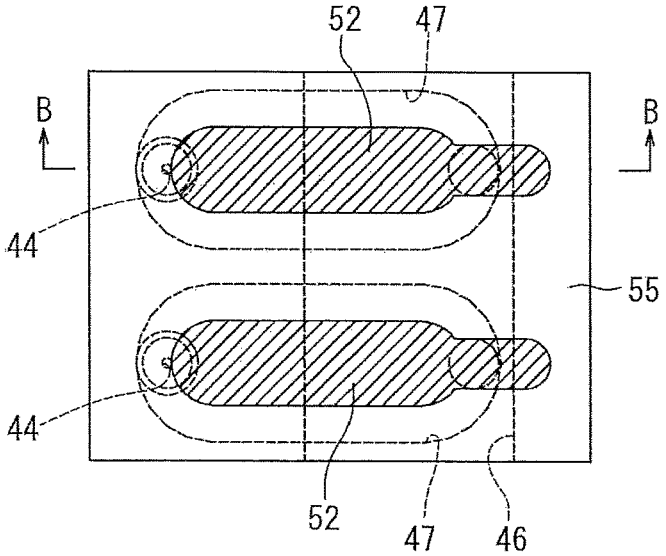
FIG. 5B is an enlarged view of the area A in FIG. 5A.
Figure 5C:
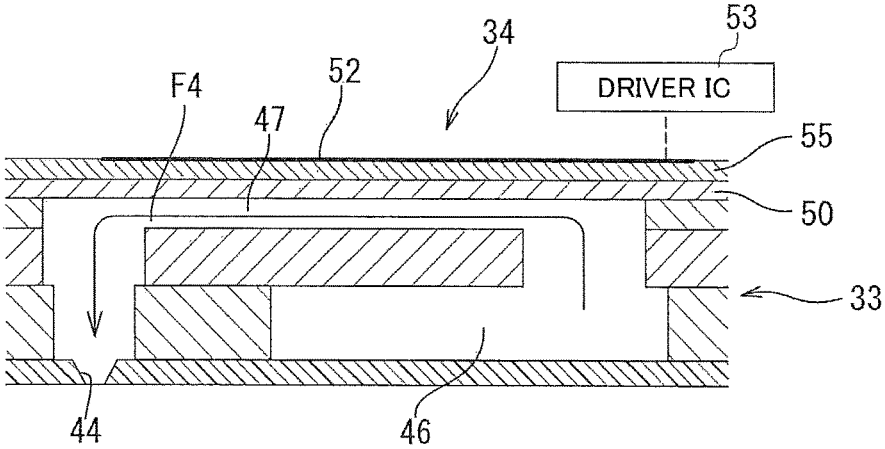
FIG. 5C is a cross-sectional view taken along line B-B in FIG. 5B.

As illustrated in FIGS. 5A and 5B, the head 13 includes a passage unit 33 and a piezoelectric actuator 34 disposed on an upper surface of the passage unit 33. As illustrated in FIG. 5C, the passage unit 33 is constituted by four plates stacked on each other. The nozzles 44 are formed in a lower surface of the passage unit 33. As described above, the nozzles 44 constitute the four nozzle rows respectively corresponding to the four colors of the ink.

As illustrated in FIGS. 5A and 5B, the passage unit 33 has a multiplicity of pressure chambers 47 respectively communicating with the nozzles 44. The pressure chambers 47 are arranged in four rows like the nozzles 44. The passage unit 33 further has four manifolds 46 each extending in the conveying direction. The four manifolds 46 correspond to the respective four colors of the ink. Each of the four manifolds 46 supplies the ink to the pressure chambers 47 forming a corresponding one of the four pressure-chamber rows.

The four manifolds 46 respectively connected to four ink-supply holes 45 formed in the upper surface of the passage unit 33. With these constructions, the passage unit 33 has the head liquid passages F4 each extending from a corresponding one of the ink-supply holes 45 to a corresponding one of the nozzles 44 via a corresponding one of the manifolds 46 and a corresponding one of the pressure chambers 47.

As illustrated in FIG. 5C, the piezoelectric actuator 34 includes: a vibration plate 50 covering the pressure chambers 47; a piezoelectric layer 55 disposed on an upper surface of the vibration plate 50; and a multiplicity of individual electrodes 52 corresponding to the respective pressure chambers 47. Each of the individual electrodes 52 disposed on an upper surface of the piezoelectric layer 55 is connected to a driver IC 53 for driving the piezoelectric actuator 34. The vibration plate 50 located just under the piezoelectric layer 55 is formed of metal and serves as a common electrode opposed to the individual electrodes 52, with the piezoelectric layer 55 between the common electrode and the individual electrodes 52. It is noted that this vibration plate 50 is connected to a ground wiring of the driver IC 53 and always kept at ground potential.

When a predetermined drive voltage is applied from the driver IC 53 to a portion of the piezoelectric layer 55 which is located between one of the individual electrodes 52 and the vibration plate 50 as the common electrode, piezoelectric deformation is caused at the portion of the piezoelectric layer 55. This piezoelectric deformation changes the volume of a corresponding one of the pressure chambers 47, thereby applying pressure (i.e., ejection energy) to the ink in the pressure chamber 47. As a result, a droplet of the ink is ejected from the nozzle 44 communicating with the pressure chamber 47. While the piezoelectric actuator 34 is employed for applying pressure to the ink in the present embodiment, the present disclosure is not limited to this configuration. For example, a heater for heating the ink to cause film boiling may be employed for applying pressure to the ink.

There will be next described the sub-tank 14 in detail with reference to FIGS. 2 and 3. The sub-tank 14 is a liquid-passage defining member including a resin member 60 and films 78. The sub-tank 14 defines therein four supply liquid passages F3 each for supplying the ink of a corresponding one of the four colors to the head 13. It is noted that FIGS. 2 and 3 illustrate a structure of connections of the supply liquid passages F3 corresponding to one of the four colors.

The resin member 60 is formed of synthetic resin such as polypropylene. This resin member 60 includes: a main body 61 shaped like a plate extending along the horizontal plane; a coupling portion 62 extending vertically downward from one end portion of the main body 61; and the joint 21 mounted on an upper surface of the main body 61. The four ink-supply tubes 22 connected to the cartridge holder 6 (see FIG. 1) are removably connected to the joint 21.

Each of the supply liquid passages F3 includes: a joint liquid passage F31 formed in the joint 21; a main-body liquid passage F32 formed in the main body 61; and a coupling-portion liquid passage F33 formed in the coupling portion 62.

Four ink inlets 64 are formed in the upper surface of the main body 61 so as to respectively correspond to the four colors of the ink. The four main-body liquid passages F32 are connected at their respective one ends to the respective ink inlets 64. The joint 21 is mounted on the upper surface of the main body 61 so as to cover the ink inlets 64. The joint liquid passages F31 formed in the joint 21 connect the respective ink inlets 64 and the respective tube liquid passages F2 to each other.

The main-body liquid passages F32 extend along the horizontal plane. The coupling-portion liquid passages F33 extend vertically downward from their respective one end portions (i.e., upper end portions) connected to the respective main-body liquid passages F32. Each of the main-body liquid passages F32 includes: a damper chamber 71 for damping pressure fluctuations caused in the ink in the main-body liquid passage F32; and liquid passages 72, 73 respectively arranged in front of and at a rear of the damper chamber 71. Each of the damper chambers 71 is a recessed portion formed in a surface of the main body 61. The four damper chambers 71 respectively corresponding to the four colors of the ink are formed such that two of the four damper chambers 71 are formed in the upper surface of the main body 61, and the other two of the four damper chambers 71 are formed in a lower surface of the main body 61. Each of the damper chambers 71 formed in the upper surface of the main body 61 and a corresponding one of the ink inlets formed in the upper surface of the main body 61 are connected to each other by a corresponding one of the liquid passages 72 each in the form of a groove formed in the upper surface of the main body 61. Each of the damper chambers 71 is connected to a corresponding one of the coupling-portion liquid passages F33 formed in the coupling portion 62, by a corresponding one of the liquid passages 73 formed in the upper surface of the main body 61.

As illustrated in FIG. 2, the main body 61 further has four groove-like air-discharge passages 74 connecting the respective four coupling-portion liquid passages F33 and the respective four air-discharge portions 23 to each other. That is, the main body 61 has the air-discharge passages 74 each branching off from a portion of a corresponding one of the supply liquid passages F3 and extending to the outside. It is noted that FIG. 2 illustrates only one of the air-discharge passages 74 formed in the upper surface of the main body 61 for simplicity.

The films 78 are respectively welded to the upper and lower surfaces of the main body 61. Thus, the recessed damper chambers 71, the groove-like liquid passages 72, 73, and the groove-like air-discharge passages 74 formed in the main body 61 are covered by the films 78 from above or below.

Unlike the ink-supply tube 22, the sub-tank 14 does not hinder movement of the carriage 3 even in the case where the sub-tank 14 has high stiffness. Thus, a three-layer film is employed for each of the films 78. Specifically, as illustrated in FIG. 3, each of the films 78 is constituted by (i) an inner layer 78*a* formed of polypropylene, (ii) a middle layer 78*b* formed of polyethylene terephthalate (PET), and (iii) an outer layer 78*c* having high gas barrier properties and formed by thin film deposition in which an inorganic oxide is applied to resin such as polyethylene terephthalate. One example of the outer layer 78*c* is a GL film (manufactured by TOPPAN PRINTING CO., LTD). Since each of the films 78 has the above-described three-layer structure, and the outer layer 78*c* has high gas barrier properties, the gas permeability of the film 78 is lower than that of the ink-supply tube 22 having a single-layer structure. That is, the gas barrier properties of the film 78 are higher than those of the ink-supply tube 22. Also, the resin member 60 has higher gas barrier properties than the ink-supply tube 22 because an outer wall of the resin member 60 which defines the liquid passages is large, for example.

In view of the above, the sub-tank 14 defining the supply liquid passages F3 is a liquid-passage defining member having a lower gas permeability (higher gas barrier properties) than the ink-supply tube 22 defining the tube liquid passage F2. It is noted that the gas permeability as an indicator of the gas barrier properties may be measured according to JISK7126, for example.

The four coupling-portion liquid passages F33 formed in the coupling portion 62 are connected at their respective lower ends to the respective four ink-supply holes 45 formed in the head unit 5 in a state in which upper ends of the coupling-portion liquid passages F33 are closed by the film 78. An upper end portion of each of the coupling-portion liquid passages F33 constitutes the air storage chamber 75

(see FIG. 3) capable of temporarily storing air. The air storage chambers 75 are located at the same height level as the main-body liquid passages F32. That is, each of the air storage chambers 75 is located at the uppermost position in the main-body liquid passages F32 and the coupling-portion liquid passages F33. Thus, the air in the supply liquid passages F3 can be temporarily stored in the air storage chambers 75 without flowing into the head 13. It is noted that the liquid passages connecting the head 13 and the ink cartridges 42 to each other and constituted by the internal passage F1, the tube liquid passages F2, and the supply liquid passages F3 may be collectively referred to as "ink passage F5" (see FIG. 3).

There will be next explained processings executed by the CPU 101. In the present embodiment, according to the programs stored in the ROM 102, the CPU 101 executes various processings including a print processing, a maintenance processing, an air-position obtaining processing, an air-volume calculating processing, and a purging-amount setting processing.

The CPU 101 executes the print processing when a print instruction is received from an external device 200 (see FIG. 4) such as a personal computer (PC) via the communication interface 110, for example. In this print processing, the CPU 101 controls the devices such as the head 13 and the carriage driving motor 20 to print an image on the sheet P.

In the maintenance processing, the CPU 101 controls the purging device 9 to selectively perform the suction purging and the air-discharge purging to maintain and recover the performance of the ink ejection of the head 13. In the present embodiment, the maintenance processing is broadly classified into a regular maintenance processing and a user maintenance processing.

The regular maintenance processing is a maintenance processing which is automatically executed at evenly spaced periods of time according to a control sequence. In each regular maintenance processing, the CPU 101 controls the purging device 9 to perform the suction purging and the air-discharge purging. Thus, the suction purging and the air-discharge purging are performed regularly. These regular purgings maintain good performance of the ink ejection of the head 13, allowing the CPU 101 to start the print processing without executing the maintenance processing when the print instruction is received. That is, it is possible to shorten a length of time from a reception of the print instruction to a start of the print processing. In the present embodiment, the CPU 101 executes the regular maintenance processing each time when one month passes. An amount of the ink discharged in the suction purging in the regular maintenance processing is fixed. Likewise, an amount of the ink and air discharged in the air-discharge purging in the regular maintenance processing is fixed. The amount of the ink discharged in the suction purging and the amount of the ink and air discharged in the air-discharge purging may be hereinafter collectively referred to as "purging amount". Also, in the following description, the suction purging executed in the regular maintenance processing may be referred to as "regular suction purging", and the air-discharge purging executed in the regular maintenance processing may be referred to as "regular air-discharge purging".

The user maintenance processing is a maintenance processing which is executed when the touch screen 99 is operated by the user. In this user maintenance processing, the CPU 101 executes the purging device 9 to perform the suction purging. A force applied to the ink in the ink passage F5 by the suction pump 11 to transfer the ink (i.e., a suction pressure force) is larger in the suction purging in the user maintenance processing than in the suction purging in the regular suction purging. Specifically, in the suction purging in the user maintenance processing, the speed of rotation of the suction pump 11 is faster, and a time of driving of the suction pump 11 is longer than in the suction purging in the regular suction purging. Thus, even in the case where the performance of the ink ejection cannot be recovered by the regular maintenance processing due to a large increase in viscosity of the ink in the head 13, it is possible to recover the performance of the ink ejection by executing the user maintenance processing.

Before explaining the air-position obtaining processing, the air-volume calculating processing, and the purging-amount setting processing, there will be next explained preconditions for these processings.

In the present embodiment, as described above, the CPU 101 executes the regular maintenance processing each time when one month passes. That is, each time when one month passes, the ink not used for the print processing is discharged in the regular suction purging and the regular air-discharge purging. Here, intervals at which the print processing is executed are in some cases longer than intervals at which the regular maintenance processing is executed. For example, in the case where a user of the printer 1 uses the printer 1 only once a year or a half a year, the print processing is executed only once a year or a half a year. An unnecessarily large amount of the ink is discharged if the purging device 9 is controlled to perform the regular suction purging and the regular air-discharge purging once a month even in the case where a state in which the print processing is not executed for a long time.

To solve this problem, in the present embodiment, in the case where a situation of execution of the print processing in the past one month is a particular situation at the timing of execution of the regular maintenance processing, the CPU 101 does not cause the purging device 9 to perform the regular suction purging and the regular air-discharge purging in the regular maintenance processing (that is, the regular suction purging and the regular air-discharge purging in the regular maintenance processing are not performed). Specifically, in the case where the number of printed pages (sheets) within the latest particular period (one month in the present embodiment) is greater than or equal to the particular number (one in the present embodiment), the CPU 101 controls the purging device 9 to perform the regular suction purging and the regular air-discharge purging at the timing of execution of the regular maintenance processing. In the case where the number of printed pages within the latest particular period is less than the particular number (zero in the present embodiment), on the other hand, the CPU 101 does not cause the purging device 9 to perform the regular suction purging and the regular air-discharge purging at the timing of execution of the regular maintenance processing. That is, in the case where the number of printed pages within the past one month is zero, the CPU 101 suspends regular performance of the regular suction purging and the regular air-discharge purging. After the suspension of regular performance of the regular suction purging and the regular air-discharge purging, when the next print instruction is received, the CPU 101 controls the purging device 9 to perform the suction purging for discharging high-viscosity ink near the nozzles 44. This suction purging may be hereinafter referred to as "before-printing suction purging".

The CPU 101 as described above suspends regular performance of the regular suction purging and the regular air-discharge purging in accordance with the situation of execution of the print processing within the past one month as described above, resulting in reduced consumption of the ink discharged in the suction purging. In the case where regular performance of the regular suction purging and the regular air-discharge purging is suspended, however, air (air bubbles) in the ink passage F5 in some cases increases in size, which may increase the purging amount in the air-discharge purging when the air is discharged, leading to discharge of a larger amount of the ink on the contrary. This situation will be explained below specifically.

The air in the ink passage F5 includes: flowed-in air having flowed from the ink inlet opening 93*a* of the needle 93 located at an end of the ink passage F5; and air other than the flowed-in air. One example of the flowed-in air is air having flowed from the ink inlet opening 93*a* of the needle 93 to the ink passage F5 when the ink cartridge 42 is mounted onto the cartridge holder 6, and the needle 93 is inserted into the outlet pipe 42*b*. Examples of the air other than the flowed-in air include: fine air contained in the ink; and air created by vaporization of water of the ink in the ink passage F5 due to an elapse of time. The volume of the flowed-in air in its initial state (i.e., the volume of the flowed-in air when the air has flowed in the ink passage F5) is usually large when compared with the air other than the flowed-in air.

These kinds of air in the ink passage F5 increases in size with time by penetration of atmosphere through an outer wall of the liquid-passage defining member. That is, the volume V of the air increases with time. In the case where a time elapsed from a reference time point is defined as t, the volume V of the air may be calculated based on the following expression (1):

$$V=Ae^{Bt} \quad (1)$$

Each of A, B is a coefficient, and e is the base of natural logarithms.

The coefficient A represents the volume of air at the reference time point. The greater the gas permeability of the liquid-passage defining member forming the liquid passage containing air, the larger the coefficient B is. That is, this coefficient B is determined by, e.g., a material of the liquid-passage defining member, and the thickness of an outer wall of the liquid-passage defining member which defines the liquid passage.

As described above, the ink-supply tube 22 is a liquid-passage defining member having a greater gas permeability than the sub-tank 14. Thus, a value of the coefficient B corresponding to the ink-supply tube 22 is greater than a value of the coefficient B corresponding to the sub-tank 14. In the present embodiment, the value of the coefficient B corresponding to the ink-supply tube 22 is about sixteen times greater than the value of the coefficient B corresponding to the sub-tank 14. Thus, a degree of increase of the size of air (i.e., a rate of increase of the size of air) is greater when air exists in the tube liquid passage F2 of the ink-supply tube 22 than when air exists in the supply liquid passage F3 defined in the sub-tank 14.

The air in the ink passage F5 usually remains at its position unless a flow of the ink from the needle 93 toward the nozzles is generated in the ink passage F5. That is, the air in the ink passage F5 does not move unless the print processing or the maintenance processing is executed. Accordingly, in the case where neither the print processing nor the regular maintenance processing is executed when air exists in the tube liquid passage F2, the size of the air increases by a large amount. In the case where the flowed-in air whose volume is large at its inflow in particular remains in the tube liquid passage F2 for a long time, the volume of the air increases considerably by the time when the flowed-in air has reached the air storage chamber 75. Thus, the purging amount in the air-discharge purging for discharging this flowed-in air is considerably large.

On the other hand, since the gas permeability of the sub-tank 14 is low, even in case where air remains in the supply liquid passage F3 for a long time, the size of the air hardly increases. That is, the flowed-in air hardly increases in size even when neither the print processing nor the regular maintenance processing is executed in the case where the flowed-in air remains in the supply liquid passage F3. Accordingly, even in the case where the flowed-in air remains in the supply liquid passage F3 for a long time, the purging amount in the air-discharge purging for discharging this flowed-in air hardly increases.

Accordingly, even in the case where the number of printed pages within the past one month is zero, when the flowed-in air remains in the tube liquid passage F2, the regular suction purging and the regular air-discharge purging are preferably executed regularly to shorten a time of remaining of the flowed-in air in the tube liquid passage F2 to reduce increase in the size of the flowed-in air.

Thus, in the present embodiment, in the case where the number of printed pages within the past one month is greater than or equal to one at the timing of execution of the regular maintenance processing or in the case where the flowed-in air is in the tube liquid passage F2 at the timing of execution of the regular maintenance processing, the CPU 101 controls the purging device 9 to perform the regular suction purging and the regular air-discharge purging. On the other hand, in the case where the number of printed pages within the past one month is zero at the timing of execution of the regular maintenance processing and in the case where the flowed-in air is in the supply liquid passage F3 at the timing of execution of the regular maintenance processing, the CPU 101 does not cause the purging device 9 to perform the regular suction purging and the regular air-discharge purging. The air-position obtaining processing, the air-volume calculating processing, and the purging-amount setting processing are executed for these controls. The processings will be explained below in detail.

In the air-position obtaining processing, the CPU 101 obtains air-position information 104*c* relating to a position of the flowed-in air in the ink passage F5. As illustrated in FIG. 4, the non-transitory memory 104 stores a total-amount counter 104*a* and air-volume information 104*b* used in the air-position obtaining processing.

The total-amount counter 104*a* is configured to count a total-amount count value which indicates a total amount of the ink and air ejected or discharged from the ink passage F5 to the outside in the print processing and the maintenance processing from a cartridge mounted timepoint. The cartridge mounted timepoint is a point in time when a signal indicating that the ink cartridge 42 is mounted on the cartridge holder 6 is received from the sensor 95.

The air-volume information 104*b* indicates the volume of the flowed-in air in the ink passage F5. The volume of the flowed-in air which is indicated by the air-volume information 104*b* is initialized to an amount of the flowed-in air in an initial state at the cartridge mounted timepoint. The amount of the flowed-in air in the initial state is an amount of air flowing from the ink inlet opening 93*a* of the needle 93 when the ink cartridge 42 is mounted on the cartridge holder 6. This amount of the flowed-in air in the initial state is determined empirically.

Each time when one of the print processing and the maintenance processing is executed, the CPU 101 calculates a total amount of the ink and the air discharged from the ink passage F5 to the outside in the print processing or the maintenance processing and adds the calculated total amount to the total-amount count value of the total-amount counter 104*a*. It is noted that an amount of the ink ejected from the nozzles 44 by driving of the piezoelectric actuator 34 in the print processing may be calculated based on image data, based on which printing is performed in the print processing. The purging amount in each of the suction purging and the air-discharge purging in the maintenance processing may be calculated based on the rotational speed and the driving time of the suction pump 11.

The CPU 101 refers to the total-amount counter 104*a* in the air-position obtaining processing to calculate a position of one of distal ends of the flowed-in air which one is nearer to the nozzles 44 than the other. Specifically, as the position of the distal end of the flowed-in air, the CPU 101 sets a position in the ink passage F5, which position is spaced apart from the ink inlet opening 93*a* of the needle 93 toward the head 13 at a distance equivalent to the total-amount count value of the total-amount counter 104*a*. In the present embodiment, the non-transitory memory 104 preliminarily stores a liquid-passage position table, not illustrated, which defines a relationship between the total-amount count value of the total-amount counter 104*a* and the position of the flowed-in air. In the air-position obtaining processing, the CPU 101 refers to the total-amount count value of the total-amount counter 104*a* and the liquid-passage position table to obtain the position of the distal end of the flowed-in air.

Here, the position of one of the distal ends of the flowed-in air, which one is located nearer to the head 13 does not change even if the flowed-in air increases in size with time, but a position of the other distal end of the flowed-in air which is nearer to the ink inlet opening 93*a* is displaced toward the ink inlet opening 93*a* if the flowed-in air increases in size with time. The position of the distal end of the flowed-in air is preferably obtained as the position of the flowed-in air to appropriately execute the purging-amount setting processing which will be described below.

Thus, the CPU 101 in the air-position obtaining processing sets, as the position of the flowed-in air (i.e., the position of the distal end of the flowed-in air), a position in the ink passage F5, which position is spaced apart from the position of the distal end of the flowed-in air toward the ink inlet opening 93*a* at a distance equivalent to the volume indicated by the air-volume information 104*b*. The air-position information 104*c* relating to the position of the flowed-in air and obtained in the air-position obtaining processing is stored into the non-transitory memory 104.

In the air-volume calculating processing, the CPU 101 calculates a length of time in which the flowed-in air remains in each of the internal passage F1, the tube liquid passages F2, and the supply liquid passages F3, based on the position of the flowed-in air which is indicated by the air-position information 104*c*, and calculates the volume of the flowed-in air based on each of the calculated times and the gas permeability of each of the liquid-passage defining members forming the respective liquid passages F1-F3. The volume of the flowed-in air which is calculated in the air-volume calculating processing is stored into the non-transitory memory 104 as the air-position information 104*c*.

Specifically, the CPU 101 in the air-volume calculating processing sets a later one of the cartridge mounted timepoint and a timepoint of execution of the preceding air-volume calculating processing as the reference time point and substitutes values into the elapsed time t and the coefficients A, B in the above-described expression (1) to calculate the current volume of the air. The CPU 101 substitutes, into the elapsed time t, a time elapsed from a later one of the cartridge mounted timepoint and the timepoint of execution of the preceding air-volume calculating processing. The CPU 101 substitutes, into the coefficient A, the volume of the air which is indicated by the air-volume information 104*b*. The CPU 101 substitutes, into the coefficient B, a value corresponding to the liquid-passage defining member forming the liquid passage containing the position of the flowed-in air, which position is indicated by the air-position information 104*c*. For example, in the case where the flowed-in air exists in the tube liquid passage F2, a value corresponding to the ink-supply tube 22 is substituted into the coefficient B, and in the case where the flowed-in air exists in the supply liquid passage F3, a value corresponding to the sub-tank 14 is substituted into the coefficient B. The calculated volume of the air is stored into the non-transitory memory 104 as new air-volume information 104*b*.

In the purging-amount setting processing, the purging amount (i.e., the total amount of air and the ink) in each of the regular suction purging and the regular air-discharge purging is made smaller when the position of the flowed-in air which is indicated by the air-position information 104*c* is located in the supply liquid passage F3 than when the position of the flowed-in air which is indicated by the air-position information 104*c* is located in the tube liquid passage F2. That is, in the purging-amount setting processing, an amount of the ink forcibly discharged from the nozzles 44 in the regular suction purging and an amount of air discharged from the supply liquid passages F3 in the regular air-discharge purging are made smaller when the position of the flowed-in air which is indicated by the air-position information 104*c* is located in the supply liquid passage F3 than when the position of the flowed-in air which is indicated by the air-position information 104*c* is located in the tube liquid passage F2.

In the present embodiment, when the position of the flowed-in air which is indicated by the air-position information 104*c* is located in the supply liquid passage F3, as described above, the CPU 101 does not cause the purging device 9 to perform the regular suction purging and the regular air-discharge purging even at the timing of execution of the regular maintenance processing, whereby the purging amount in each of the regular suction purging and the regular air-discharge purging is made smaller when the position of the flowed-in air which is indicated by the air-position information 104*c* is located in the supply liquid passage F3 than when the position of the flowed-in air which is indicated by the air-position information 104*c* is located in the tube liquid passage F2.

Also, the CPU 101 executes a determination processing in which the CPU 101 determines whether the CPU 101 controls the purging device 9 at the timing of execution of the regular maintenance processing to perform the regular suction purging and the regular air-discharge purging with the fixed purging amount that does not change depending upon the position of the flowed-in air which is indicated by the air-position information 104*c* or with the purging amount set in the purging-amount setting processing. Because the purging amount set in the purging-amount setting processing is zero, in the present embodiment, the CPU 101 in this determination processing determines whether the CPU 101 controls the purging device 9 to perform the regular suction purging and the regular air-discharge purging. The non-transitory memory 104 stores print information 104*d* and an air-undischarged flag 104*e* used in the determination processing.

The print information 104*d* contains (i) the number of printed pages in each of the print processings and (ii) the date and time at which each print processing is executed. The number of printed pages and the date and time are associated with each other. The air-undischarged flag 104*e* is in an ON state when the flowed-in air exists in the ink passage F5. The air-undischarged flag 104*e* is an OFF state when the flowed-in air is discharged to the outside of the ink passage F5 by the air-discharge purging.

The CPU 101 in the determination processing refers to the print information 104*d* to determine that the CPU 101 controls the purging device 9 to perform the regular suction purging and the regular air-discharge purging, when the number of printed pages within the past one month is greater than or equal to one, or when the position of the flowed-in air which is indicated by the air-position information 104*c* is located in the internal passage F1 or the tube liquid passage F2.

The CPU 101 in the determination processing determines that the CPU 101 does not cause the purging device 9 to perform the regular suction purging and the regular air-discharge purging, when the position of the flowed-in air which is indicated by the air-position information 104*c* is located in the supply liquid passage F3, and the number of printed pages within the past one month is zero, or when the air-undischarged flag 104*e* is in the OFF state, and the number of printed pages within the past one month is zero. That is, the regular suction purging and the regular air-discharge purging are not executed even at the timing of execution of the regular maintenance processing. In this case, the CPU 101 sets a maintenance change flag 104*f* stored in the non-transitory memory 104, to an ON state. This maintenance change flag 104*f* is in an OFF state when the regular suction purging and the regular air-discharge purging are performed regularly. The maintenance change flag 104*f* is in the ON state when the regular suction purging and the regular air-discharge purging are suspended. The CPU 101 stores the date and time at which the maintenance change flag 104*f* is changed from the OFF state to the ON state, into the non-transitory memory 104 as maintenance-change date-and-time information 104*g*.

When the maintenance change flag 104*f* is in the ON state at reception of the print instruction, the CPU 101 controls the purging device 9 to perform the before-printing suction purging before executing the print processing. The purging amount is larger in this before-printing suction purging than in the regular suction purging. The CPU 101 sets the purging amount in the before-printing suction purging such that this purging amount increases with increase in a length of time elapsed from the date and time indicated by the maintenance-change date-and-time information 104*g*. Thus, even in the case where the viscosity of the ink near the nozzles 44 is high because the regular suction purging is not executed for a long time, it is possible to discharge the high-viscosity ink from the nozzles 44 by executing the before-printing suction purging. It is noted that the purging amount in the before-printing suction purging is larger than the purging amount in one regular suction purging but smaller than a total purging amount in a plurality of the regular suction purgings.

When an air-discharge condition is satisfied in a period from the time point of reception of the print instruction to completion of the print processing executed in response to the print instruction, the CPU 101 controls the purging device 9 to execute the air-discharge purging (which may be hereinafter referred to as "printing air-discharge purging"). The air-discharge condition includes: a condition that both of the air-undischarged flag 104*e* and the maintenance change flag 104*f* are in the ON states; a condition that the position of the flowed-in air which is indicated by the air-position information 104*c* has reached the air storage chamber 75, and a condition that the volume of the flowed-in air which is indicated by the air-volume information 104*b* is greater than or equal to a threshold value. Here, when an amount of the air in the air storage chambers 75 is larger than this threshold value, a probability of flowing of air into the head 13 is greater than or equal to a predetermined value. Also, the purging amount in this printing air-discharge purging is set so as to increase with increase in the volume of the flowed-in air which is indicated by the air-volume information 104*b*. This change of the purging amount in the printing air-discharge purging in accordance with the volume of the flowed-in air which is indicated by the air-volume information 104*b* reduces the amount of the ink discharged in the printing air-discharge purging.

In the present embodiment, the CPU 101 controls the purging device 9 to perform the printing air-discharge purging before the before-printing suction purging when the air-discharge condition is satisfied after the time point of reception of the print instruction and before the before-printing suction purging. Since the before-printing suction purging in a state in which the air-discharge condition is satisfied, it is possible to prevent the flowed-in air in the supply liquid passage F3 from flowing into the head 13. Even in the case where the air-discharge condition is not satisfied before the before-printing suction purging, the air-discharge condition is in some cases satisfied after the before-printing suction purging by movement of the flowed-in air in the ink passage F5 by the before-printing suction purging. In the case where the print processing is executed in the case where the air-discharge condition is satisfied, a quality of an image to be recorded on the sheet P may be deteriorated. To solve this problem, the CPU 101 controls the purging device 9 to perform the printing air-discharge purging before the print processing in the case where the air-discharge condition is satisfied after the before-printing suction purging and before the print processing. Also, the CPU 101 sets the air-undischarged flag 104*e* to the OFF state after the printing air-discharge purging is performed.

Figure 6:
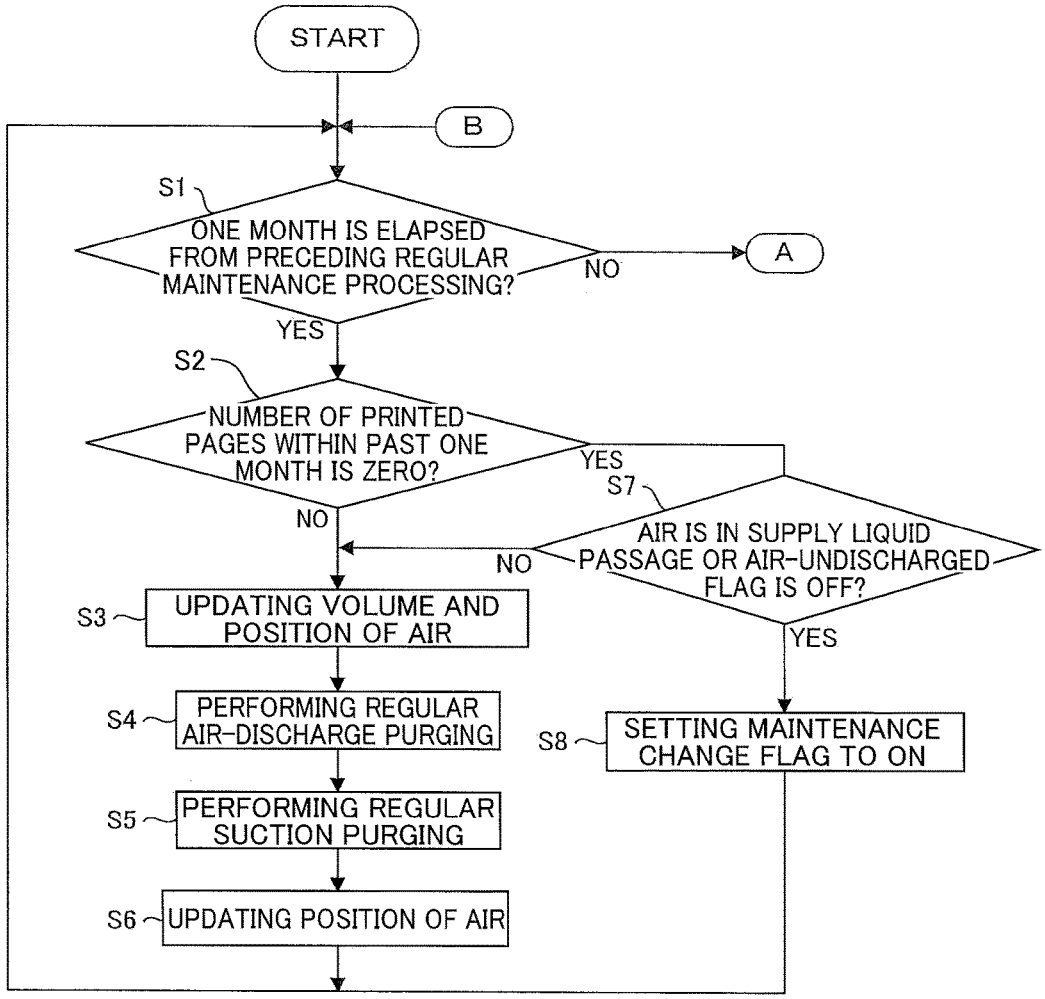
FIG. 6 is a flow chart for explaining processings and operations in the ink-jet printer.
Figure 7:
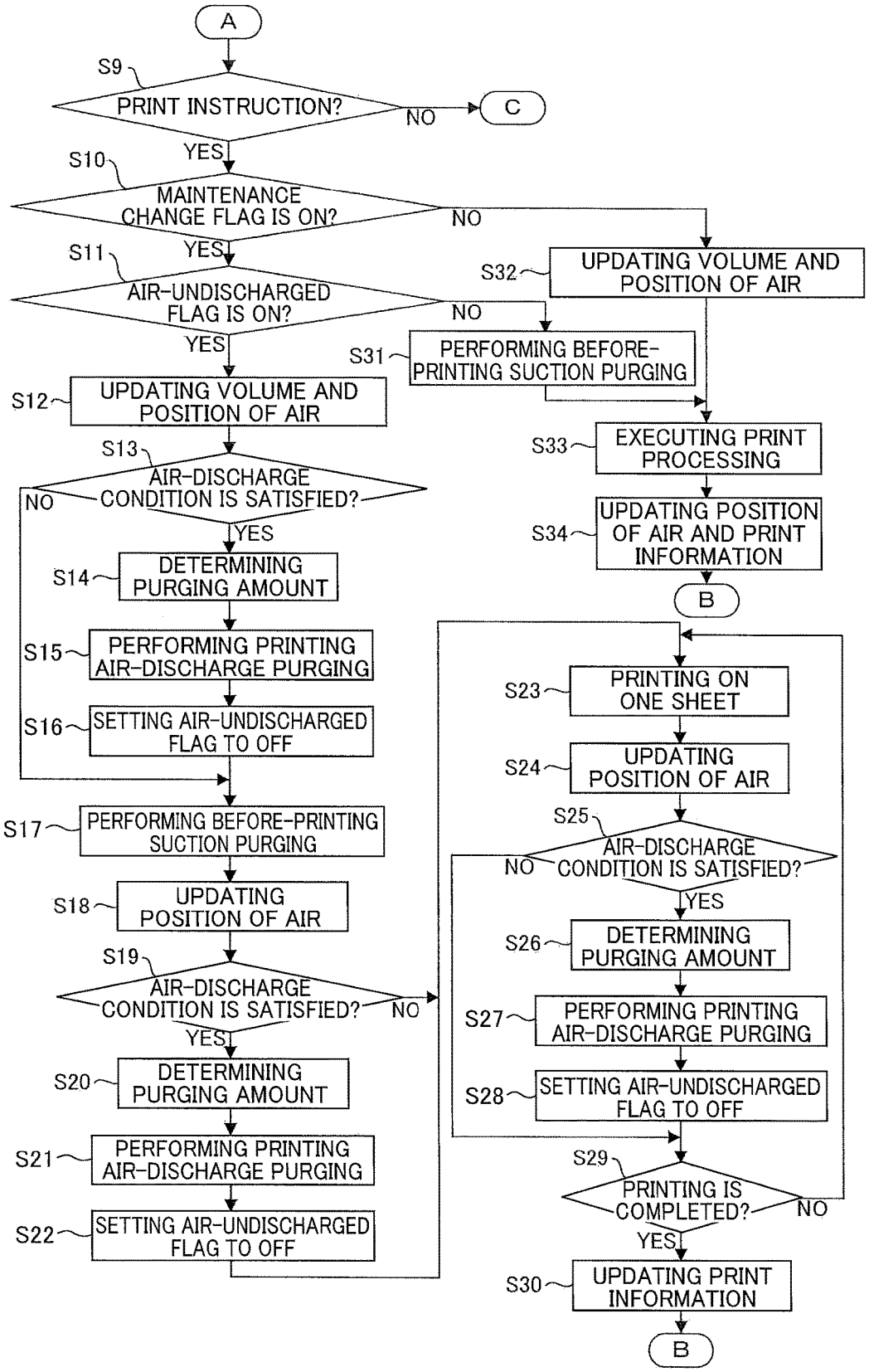
FIG. 7 is a flow chart for explaining operations and processings in the ink-jet printer.
Figure 8:
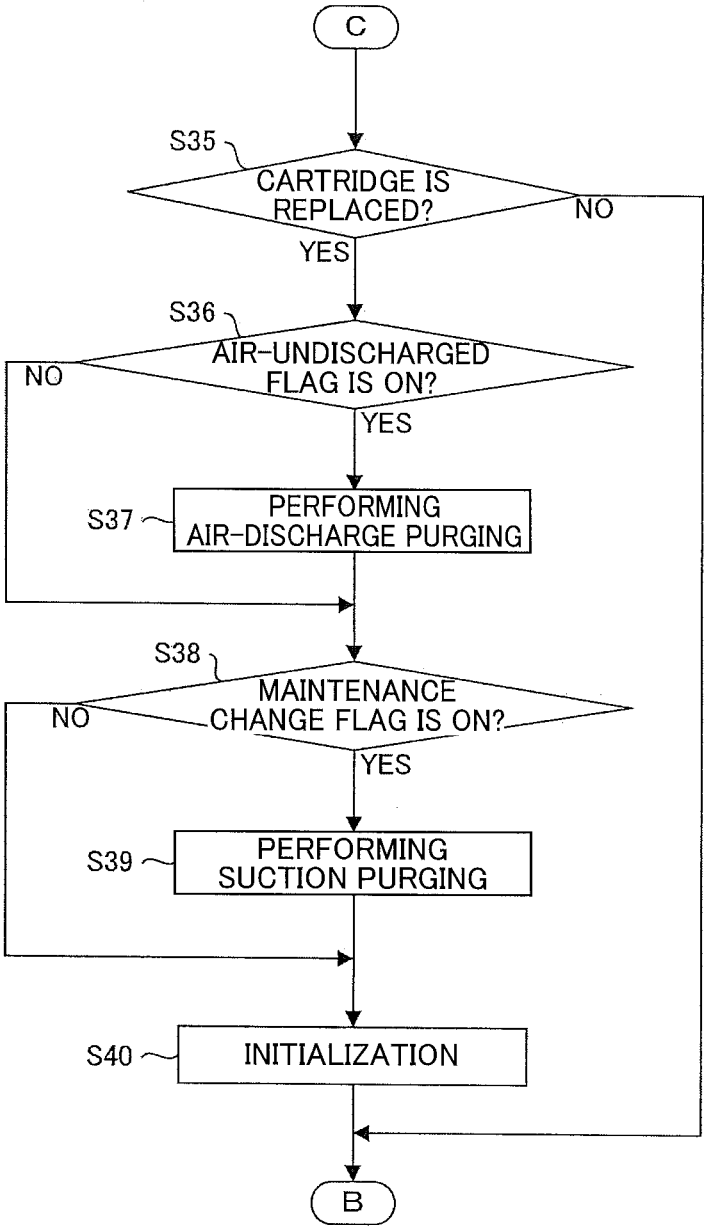
FIG. 8 is a flow chart for explaining operations and processings in the ink-jet printer.

There will be next explained one example of processings and operations in the printer 1 with reference to FIGS. 6-8.

As illustrated in FIG. 6, the CPU 101 at S1 determines whether one month is elapsed from the preceding regular maintenance processing. When the CPU 101 determines that one month is elapsed (S1: YES), the CPU 101 at S2 refers to the print information 104*d* stored in the non-transitory memory 104 to determine whether the number of printed pages within the past one month is zero. When the CPU 101 determines that the number of printed pages within the past one month is greater than or equal to one (S2: NO), the CPU 101 at S3 executes the air-volume calculating processing and the air-position obtaining processing in order to update the air-volume information 104*b* and the air-position information 104*c* stored in the non-transitory memory 104. The CPU 101 at S4 controls the purging device 9 to perform the regular air-discharge purging and at S5 controls the purging device 9 to perform the regular suction purging. The CPU 101 at S6 calculates the purging amount for each of the regular air-discharge purging and the regular suction purging, updates the total-amount count value of the total-amount counter 104*a*, and executes the air-position obtaining processing to update the air-position information 104*c*. The processings at S3 and S6 are omitted when the air-undischarged flag 104*e* is in the OFF state. Upon completion of the processing at S6, this flow returns to S1.

When the CPU 101 at S2 determines that the number of printed pages within the past one month is zero (S2: YES), the CPU 101 at S7 refers to the air-position information 104*c* and the air-undischarged flag 104*e* stored in the non-transitory memory 104 and determines whether any of a condition that the position of the flowed-in air is located in the supply liquid passage F3 and a condition that the air-undischarged flag 104*e* is in the OFF state is satisfied. When the CPU 101 determines that neither of the condition that the position of the flowed-in air is located in the supply liquid passage F3 nor the condition that the air-undischarged flag 104*e* is in the OFF state is satisfied (S7: NO), the CPU 101 determines that the CPU 101 controls the purging device 9 to perform the regular suction purging and the regular air-discharge purging, and this flow goes to S3.

On the other hand, when the CPU 101 determines that any of the condition that the position of the flowed-in air is located in the supply liquid passage F3 and the condition that the air-undischarged flag 104*e* is in the OFF state is satisfied (S7: YES), the CPU 101 sets the purging amount in each of the regular suction purging and the regular air-discharge purging in the regular maintenance processing at this time, to zero so as not to cause the purging device 9 to perform the regular suction purging and the regular air-discharge purging. That is, the CPU 101 suspends regular performance of the regular suction purging and the regular air-discharge purging. The CPU 101 at S8 sets the maintenance change flag 104*f* stored in the non-transitory memory 104 to the ON state and stores the current date and time into the maintenance-change date-and-time information 104*g*. Upon completion of this processing, this flow returns to S1.

When the CPU 101 at S1 determines that one month is not elapsed from the preceding regular maintenance processing (S1: NO), as illustrated in FIG. 7, the CPU 101 at S9 determines whether a print instruction is received. When the CPU 101 determines that the print instruction is received (S9: YES), the CPU 101 at S10 determines whether the maintenance change flag 104*f* stored in the non-transitory memory 104 is in the ON state. When the CPU 101 determines that the maintenance change flag 104*f* is in the OFF state (S10: NO), the CPU 101 at S32 executes the air-volume calculating processing and the air-position obtaining processing in this order to update the air-volume information 104*b* and the air-position information 104*c* stored in the non-transitory memory 104. It is noted that this processing at S32 is omitted when the air-undischarged flag 104*e* is in the OFF state. This flow then goes to S33.

When the CPU 101 determines that the maintenance change flag 104*f* is in the ON state (S10: YES), the CPU 101 at S11 determines whether the air-undischarged flag 104*e* is in the ON state. When the CPU 101 determines that the air-undischarged flag 104*e* is in the ON state (S11: YES), the CPU 101 at S12 determines that the flowed-in air is in the ink passage F5, executes the air-volume calculating processing and the air-position obtaining processing in this order, and updates the air-volume information 104*b* and the air-position information 104*c* stored in the non-transitory memory 104.

The CPU 101 at S13 refers to the air-volume information 104*b*, the air-position information 104*c*, the air-undischarged flag 104*e*, and the maintenance change flag 104*f* stored in the non-transitory memory 104 to determine whether the air-discharge condition is satisfied. When the CPU 101 determines that the air-discharge condition is not satisfied (S13: NO), this flow goes to S17. When the CPU 101 determines that the air-discharge condition is satisfied (S13: YES), the CPU 101 at S14 determines the purging amount in the printing air-discharge purging based on the volume of the flowed-in air which is indicated by the air-volume information 104*b*. The CPU 101 at S15 controls the purging device 9 to perform the printing air-discharge purging with the determined purging amount. As a result, the flowed-in air in the ink passage F5 is discharged to the outside via the air-discharge passage 74. Thereafter, the CPU 101 at S16 sets the air-undischarged flag 104*e* stored in the non-transitory memory 104 to the OFF state, and this flow goes to S17.

At S17, the CPU 101 refers to the maintenance-change date-and-time information 104*g* to determine the purging amount in the before-printing suction purging and thereafter controls the purging device 9 to perform the before-printing suction purging. As a result, the high-viscosity ink is discharged from the nozzles 44. The CPU 101 at S18 calculates the purging amount in the before-printing suction purging to update the total-amount count value of the total-amount counter 104*a* and thereafter executes the air-position obtaining processing to update the air-position information 104*c*. It is noted that the processing at S18 is omitted when the air-undischarged flag 104*e* is in the OFF state.

The CPU 101 at S19 refers to the air-position information 104*c* and determines whether the air-discharge condition is satisfied due to movement of the flowed-in air in the before-printing suction purging at S17. When the CPU 101 determines that the air-discharge condition is not satisfied (S19: NO), this flow goes to S23. When the CPU 101 determines that the air-discharge condition is satisfied (S19: YES), the CPU 101 executes processings at S20-23 similar to those at S14-S16, and this flow goes to S23. It is noted that the processings at S19-S22 are omitted when the air-undischarged flag 104*e* is in the OFF state.

At S23, the CPU 101 controls the head unit 5, the carriage driving motor 20, and other devices to print an image on one sheet P. The CPU 101 at S24 calculates an amount of the ink ejected from the nozzles 44 at S23 to update the total-amount count value of the total-amount counter 104*a* and thereafter executes the air-position obtaining processing to update the air-position information 104*c*. The CPU 101 at S25 refers to the air-position information 104*c* to determine whether the air-discharge condition is satisfied due to movement of the flowed-in air in the processing at S23. When the CPU 101 determines that the air-discharge condition is not satisfied (S25: NO), this flow goes to S29. When the CPU 101 determines that the air-discharge condition is satisfied (S25: YES), the CPU 101 executes processings at S26-S28 similar to those at S14-S16, and this flow goes to S29. It is noted that the processings at S24-S28 are omitted when the air-undischarged flag 104*e* is in the OFF state.

At S29, the CPU 101 determines whether the entire printing caused by the received print instruction is completed. When the CPU 101 determines that the printing has not been completed (S29: NO), this flow returns to S23. When the CPU 101 determines that the entire printing is completed (S29: YES), the CPU 101 at S30 determines that the print processing is completed, associates the number of sheets P printed in the print processing and the date and time of execution of the print processing with each other, and stores them into the print information 104*d* stored in the non-transitory memory 104. At this time, the CPU 101 switches the maintenance change flag 104*f* from the ON state to the OFF state, and this flow returns to S1.

When the CPU 101 at S11 determines that the air-undischarged flag 104*e* is in the OFF state (S11: NO), the CPU 101 at S31 determines that the flowed-in air is not in the ink passage F5, and the CPU 101 refers to the maintenance-change date-and-time information 104*g* to determine the purging amount in the before-printing suction purging and thereafter controls the purging device 9 to perform the before-printing suction purging. This flow thereafter goes to S33.

The CPU 101 at S33 controls the head 13, the carriage driving motor 20, and other devices to execute the print processing based on the received print instruction. The CPU 101 at S34 associates the number of sheets P printed in the print processing at S32 and the date and time of execution of the print processing with each other, and stores them into the print information 104*d* stored in the non-transitory memory 104. When the air-undischarged flag 104*e* is in the ON state in the processing at S34, the CPU 101 also executes the air-position obtaining processing to update the air-position information 104*c*. When the maintenance change flag 104*f* is in the ON state, the CPU 101 switches the maintenance change flag 104*f* to the OFF state. When the processing at S34 is completed, this flow returns to S1.

When the CPU 101 at S9 determines that the print instruction is not received (S9: NO), as illustrated in FIG. 8, the CPU 101 at S35 determines, based on a signal received from the sensor 95, whether the ink cartridge 42 is replaced. When the CPU 101 determines that the ink cartridge 42 is not replaced (S35: NO), this flow returns to S1.

When the CPU 101 determines that the ink cartridge 42 is replaced (S35: YES), the CPU 101 at S36 determines whether the air-undischarged flag 104*e* is in the ON state. When the CPU 101 determines that the air-undischarged flag 104*e* is in the OFF state (S36: NO), this flow goes to S38. When the CPU 101 determines that the air-undischarged flag 104*e* is in the ON state (S36: YES), the CPU 101 at S37 determines that the flowed-in air having flowed when the ink cartridge 42 is previously mounted on the cartridge holder 6 is in the ink passage F5, and the CPU 101 controls the purging device 9 to perform the air-discharge purging for discharging the flowed-in air, and this flow goes to S38.

The CPU 101 at S38 determines whether the maintenance change flag 104*f* is in the ON state. When the CPU 101 determines that the maintenance change flag 104*f* is in the OFF state (S38: NO), this flow goes to S40. When the CPU 101 determines that the maintenance change flag 104*f* is in the ON state (S38: YES), the CPU 101 at S39 determines the purging amount based on the maintenance-change date-and-time information 104*g* to discharge the high-viscosity ink near the nozzles 44 and thereafter controls the purging device 9 to perform the suction purging with the determined purging amount, and this flow goes to S40.

The CPU 101 at S40 initializes the total-amount counter 104*a*, the air-volume information 104*b*, and the air-position information 104*c* stored in the non-transitory memory 104 and switches the air-undischarged flag 104*e* to the ON state and the maintenance change flag 104*f* to the OFF state. Upon completion of the processing at S40, this flow returns to S1.

In the first embodiment described above, in the case where air exists in the tube liquid passage F2 in which air easily increases in size, the CPU 101 regularly controls the purging device 9 to perform the regular suction purging and the regular air-discharge purging, thereby reliably shortening a length of time in which air remains in the tube liquid passage F2. This shortening of the time reduces increase in the size of air in the ink passage F5. In the case where air is in the supply liquid passage F3 in which it is difficult for air to increase in size, and the number of printed pages within the past one month is zero, the CPU 101 does not cause the purging device 9 to perform the regular suction purging and the regular air-discharge purging, thereby reliably reducing ink consumption.

Even in the case where air exists in the supply liquid passage F3 in which it is difficult for air to increase in size, when the number of printed pages within the past one month is greater than or equal to one, the CPU 101 regularly controls the purging device 9 to perform the regular suction purging and the regular air-discharge purging, making it possible to shorten a length of time from a reception of the print instruction to a start of the print processing. This shortening of the time reduces a waiting time required for completion of the printing, in the case where the user of the printer 1 frequently uses the printing function of the printer 1.

Even in the case where the maintenance change flag 104*f* is in the ON state at reception of the print instruction, when the air-discharge condition is not satisfied, the CPU 101 does not cause the purging device 9 to perform the printing air-discharge purging. This configuration shortens a length of time from a reception of the print instruction to a start of the print processing.

Second Embodiment

There will be next explained a second embodiment. In the second embodiment, an execution-interval setting processing is executed instead of the purging-amount setting processing. It is noted that the same reference numerals as used in the first embodiment are used to designate the corresponding elements of the second embodiment, and an explanation of which is dispensed with.

Figure 9:
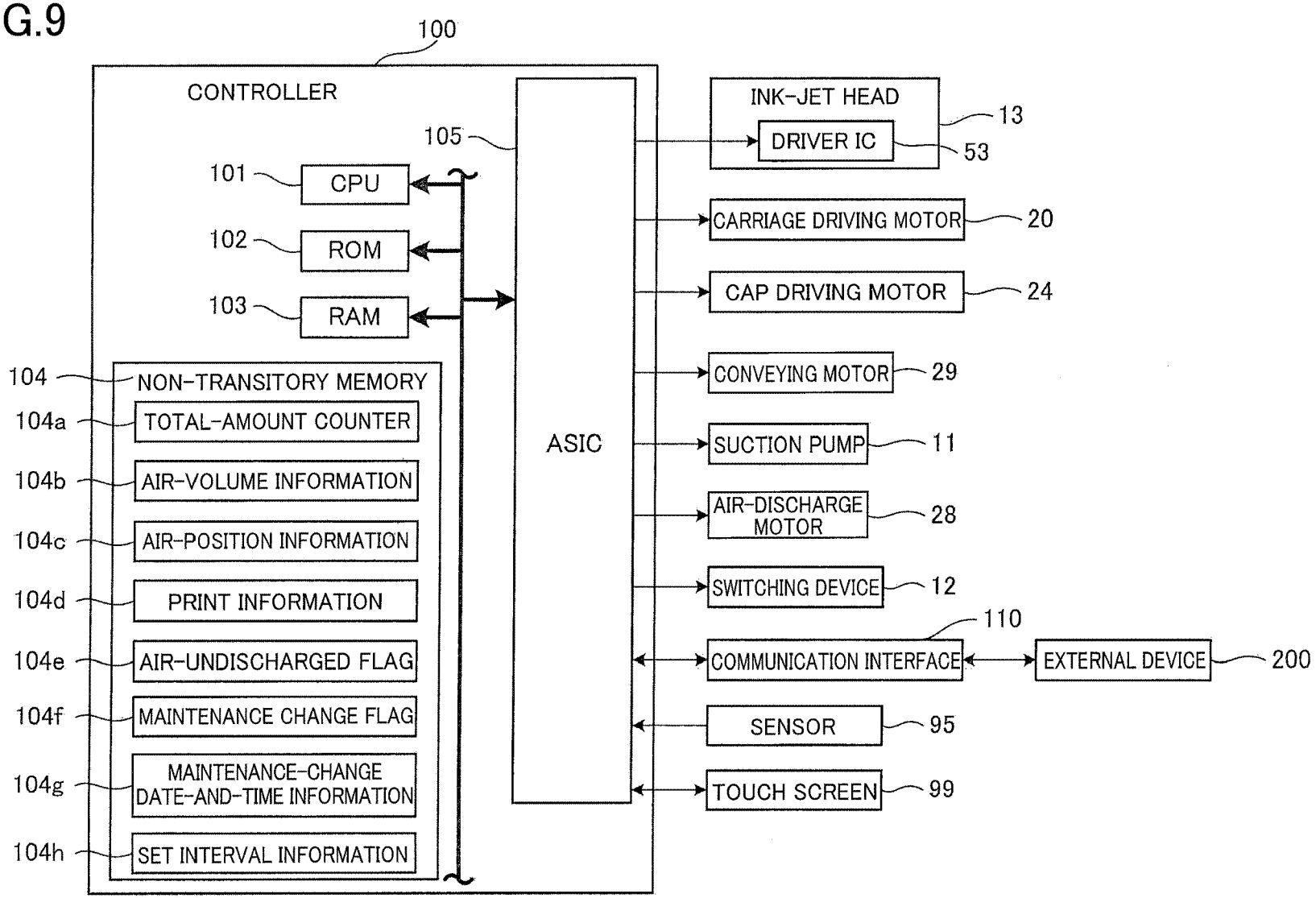
FIG. 9 is a block diagram schematically illustrating an electric configuration of an ink-jet printer according to a second embodiment.

In the execution-interval setting processing, the intervals at which the regular maintenance processing is executed are made longer when the position of the flowed-in air which is indicated by the air-position information 104*c* is located in the supply liquid passage F3 than when the position of the flowed-in air which is indicated by the air-position information 104*c* is located in the tube liquid passage F2. In the present embodiment, two months are set as each interval at which the regular maintenance processing is executed when the position of the flowed-in air which is indicated by the air-position information 104*c* is located in the supply liquid passage F3. That is, each interval at which the regular maintenance processing is executed is one month when the position of the flowed-in air which is indicated by the air-position information 104*c* is located in the internal passage F1 or the tube liquid passage F2, and the interval is two months when the position of the flowed-in air which is indicated by the air-position information 104*c* is located in the supply liquid passage F3. As illustrated in FIG. 9, the non-transitory memory 104 stores a set interval information 104*h* indicating the current intervals at which the regular maintenance processing is executed. The execution interval indicated by the set interval information 104*h* is one month at the cartridge mounted timepoint (i.e., in the initial state). The purging amount in each of the regular suction purging and the regular air-discharge purging in each regular maintenance processings is fixed without depending upon the position of the flowed-in air which is indicated by the air-position information 104*c*.

In the second embodiment, the maintenance change flag 104*f* stored in the non-transitory memory 104 is in an OFF state when a length of time elapsed from the preceding regular maintenance processing is less than one month, and the maintenance change flag 104*f* is in an ON state when the length of time elapsed from the preceding regular maintenance processing is greater than or equal to one month.

Figure 10:
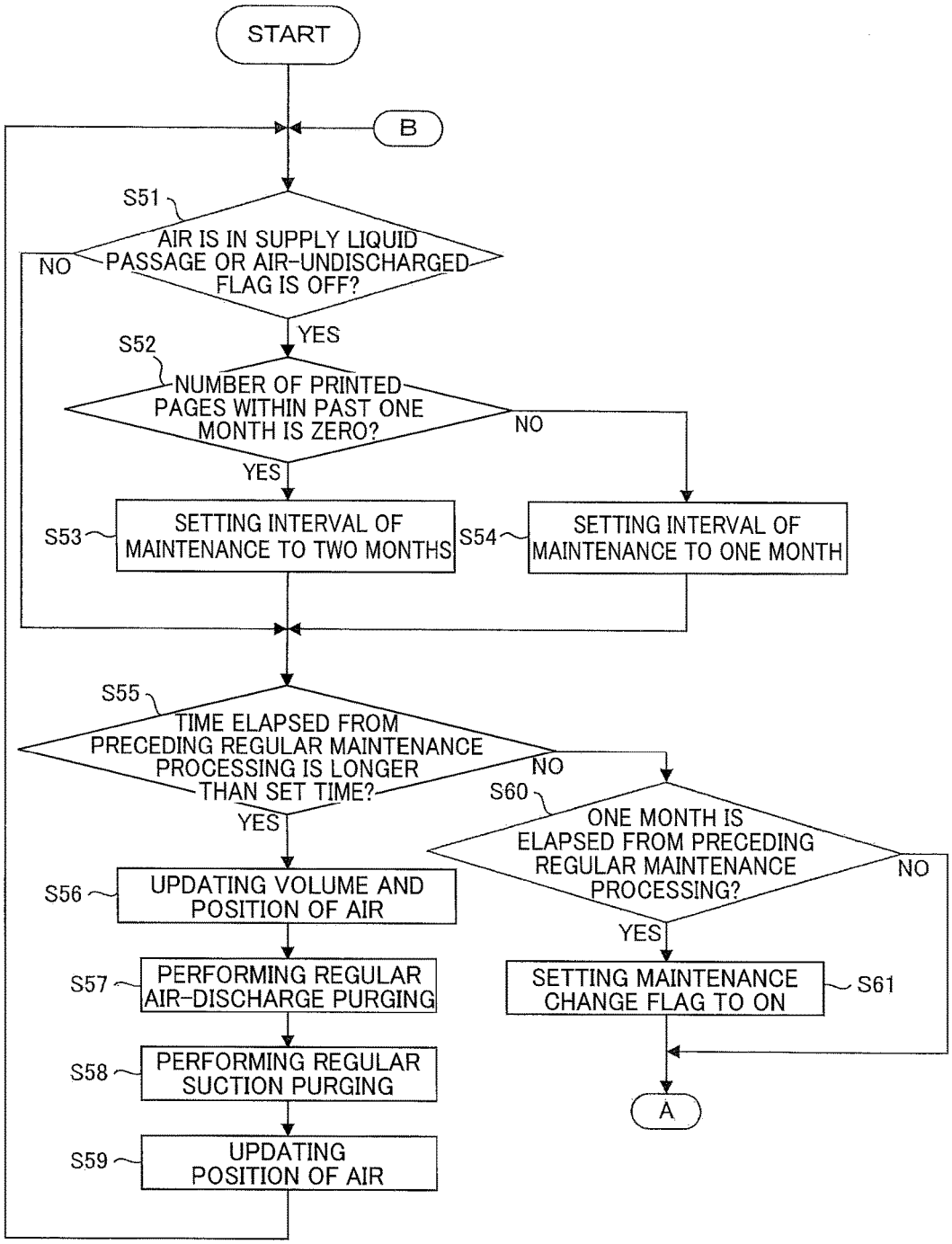
FIG. 10 is a flow chart for explaining operations and processings in the ink-jet printer according to the second embodiment.

There will be next explained one example of processings and operations in the printer 1 according to the second embodiment with reference to FIG. 10.

As illustrated in FIG. 10, the CPU 101 at S51 refers to the air-position information 104*c* and the air-undischarged flag 104*e* stored in the non-transitory memory 104 to determine whether any of the condition that the position of the flowed-in air is located in the supply liquid passage F3 and the condition that the air-undischarged flag 104*e* is in the OFF state is satisfied. When the CPU 101 determines that neither of the condition that the position of the flowed-in air is located in the supply liquid passage F3 nor the condition that the air-undischarged flag 104*e* is in the OFF state is satisfied (S51: NO), this flow goes to S55. When the CPU 101 determines that any of the condition that the position of the flowed-in air is located in the supply liquid passage F3 and the condition that the air-undischarged flag 104*e* is in the OFF state is satisfied (SM: YES), the CPU 101 at S52 refers to the print information 104*d* stored in the non-transitory memory 104 to determine whether the number of printed pages within the past one month is zero. When the CPU 101 determines that the number of printed pages within the past one month is zero (S52: YES), the CPU 101 at S53 sets each interval which is indicated by the set interval information 104*h* and at which the regular maintenance processing is executed, to two month, and this flow goes to S55. When the CPU 101 determines that the number of printed pages within the past one month is greater than or equal to one (S52: NO), the CPU 101 at S54 sets each interval which is indicated by the set interval information 104*h* and at which the regular maintenance processing is executed, to one month, and this flow goes to S55.

The CPU 101 at S55 determines whether a length of time corresponding to the execution interval indicated by the set interval information 104*h* is elapsed from the preceding regular maintenance processing. When the CPU 101 determines that the time corresponding to the execution interval indicated by the set interval information 104*h* is elapsed from the preceding regular maintenance processing (S55: YES), the CPU 101 executes processings S56-S59 similar to those at S3-S6 explained with reference to FIG. 6, and this flow returns to S51. When the CPU 101 determines that the time corresponding to the execution interval indicated by the set interval information 104*h* is not elapsed from the preceding regular maintenance processing (S55: NO), the CPU 101 at S60 determines whether one month is elapsed from the preceding regular maintenance processing. When the CPU 101 determines that one month is elapsed (S60: YES), the CPU 101 at S61 sets the maintenance change flag 104*f* to the ON state. After the processing at S61 or when the CPU 101 at S60 determines that one month is not elapsed from the preceding regular maintenance processing (S60: NO), this flow goes to S9 explained with reference to FIG. 7.

In the second embodiment described above, in the case where air exists in the tube liquid passage F2 in which air easily increases in size, the intervals at which the regular maintenance processing is executed are made shorter, thereby shortening the length of time in which air remains in the tube liquid passage F2. This shortening of the time reduces increase in the size of air in the ink passage F5. In the case where air exists in the supply liquid passage F3 in which it is difficult for air to increase in size, the intervals at which the regular maintenance processing is executed are made longer, thereby reducing ink consumption.

In the first and second embodiments described above, the ink inlet opening 93*a* of the needle 93 is one example of a liquid inlet opening, and the ink passage F5 is one example of a liquid passage. The tube liquid passage F2 is one example of a first liquid passage, and the ink-supply tube 22 is one example of a first-liquid-passage member. Each of the joint liquid passage F31 and the main-body liquid passage F32 is one example of a second liquid passage, and the sub-tank 14 is one example of a second-liquid-passage member. Each of the sub-tank 14, the ink-supply tube 22, and the resin member 91 is one example of a liquid passage definer. The suction purging is one example of a liquid purging operation, and the air-discharge purging is one example of an air-discharge purging operation. The cartridge holder 6 is one example of a tank mount.

While the embodiments have been described above, it is to be understood that the disclosure is not limited to the details of the illustrated embodiments, but may be embodied with various changes and modifications, which may occur to those skilled in the art, without departing from the spirit and scope of the disclosure. For example, in the above-described embodiments, flushing may be performed in the regular maintenance processing instead of the suction purging. That is, the flushing may be performed regularly. In this case, instead of the purging-amount setting processing, the CPU 101 executes a flushing-amount setting processing in which a flushing amount in the regular maintenance processing is made smaller when the flowed-in air indicated by the air-position information 104*c* is located in the supply liquid passage F3 than when the flowed-in air indicated by the air-position information 104*c* is located in the tube liquid passage F2.

Figure 11:
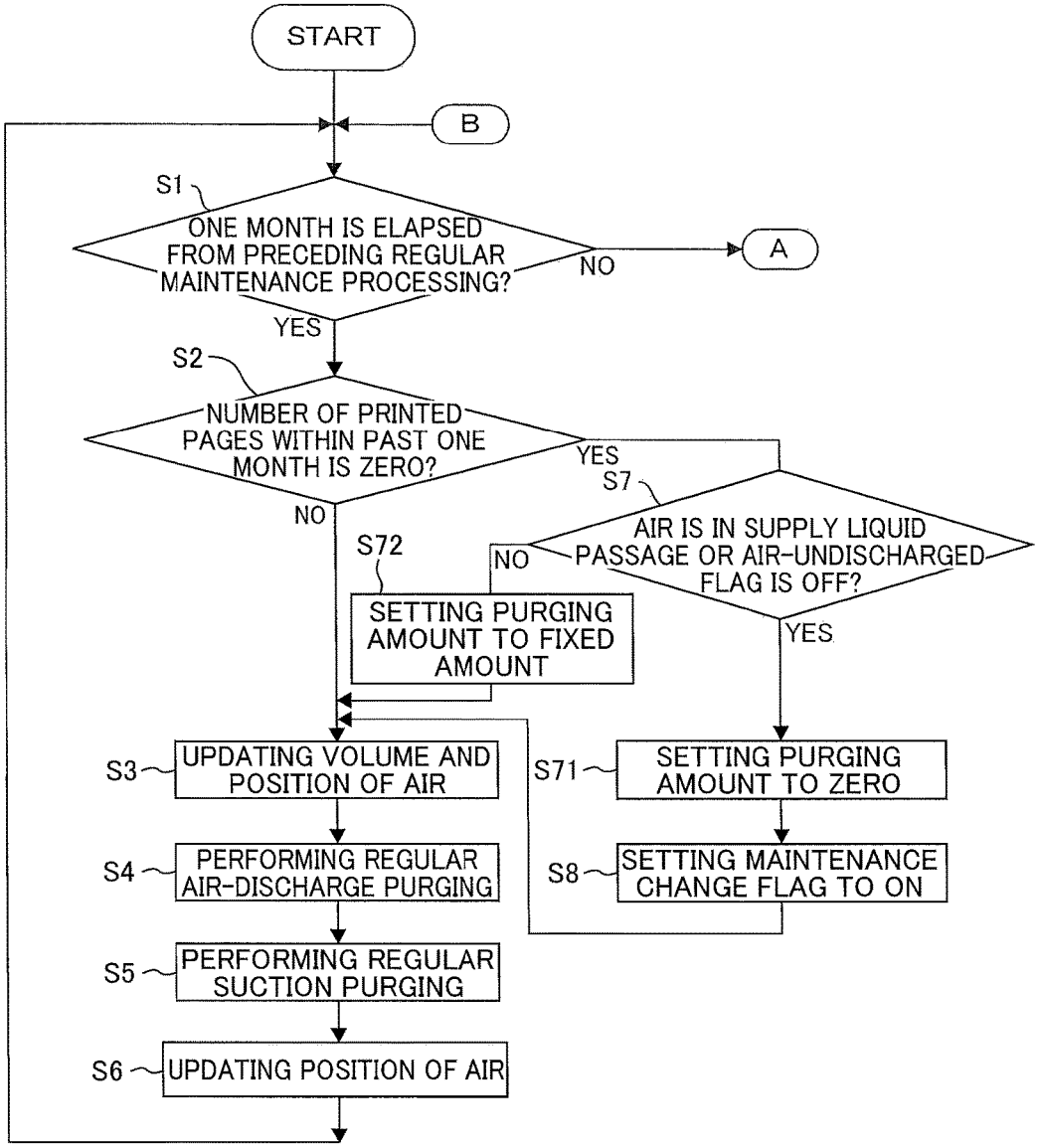
FIG. 11 is a flow chart for explaining operations and processings in an ink-jet printer according to a modification of the first embodiment.

While the purging-amount setting processing is for setting the purging amount in each of the regular suction purging and the regular air-discharge purging in the regular maintenance processing in the first embodiment, the present disclosure is not limited to this configuration. For example, the purging-amount setting processing may be for setting a purging amount in the suction purging in the user maintenance processing. Also, while the purging-amount setting processing is for setting, to zero, the purging amount in each of the regular suction purging and the regular air-discharge purging when the position of the flowed-in air which is indicated by the air-position information 104*c* is located in the supply liquid passage F3 in the first embodiment, the purging-amount setting processing may be for setting, to zero, the purging amount in any one of the regular suction purging and the regular air-discharge purging. For example, the purging-amount setting processing may be for setting the purging amount in the regular air-discharge purging to zero. The purging amount in each of the regular suction purging and the regular air-discharge purging, which purging amount is set in the purging-amount setting processing, at least has to be smaller when the position of air which is indicated by the air-position information 104*c* is located in the supply liquid passages F3 than when the position of air which is indicated by the air-position information 104*c* is located in the tube liquid passages F2. Thus, the purging amount may be larger than zero. This configuration may reduce the purging amount in the before-printing suction purging or the printing air-discharge purging executed upon reception of the print instruction, making it possible to execute the print processing earlier. Also, this printer 1 may be configured such that the purging amount in the regular suction purging which is set when the position of the flowed-in air which is indicated by the air-position information 104*c* is located in the supply liquid passage F3 is set to an amount that does not require execution of the before-printing suction purging before the print processing, and the purging amount in the regular suction purging when the position of the flowed-in air is located in the tube liquid passage F2 may be set to an amount larger than the amount that does not require execution of the before-printing suction purging before the print processing. Also, the purging-amount setting processing may be executed even when the number of printed pages within the past one month is greater than or equal to one. The purging amount in each of the regular suction purging and the regular air-discharge purging executed in the regular maintenance processing is fixed but may be changed depending upon an ambient temperature of the printer 1. Also, the printer 1 may be configured such that, in the purging-amount setting processing in the first embodiment, as illustrated in FIG. 11, when the CPU 101 at S7 determines that the position of the flowed-in air which is indicated by the air-position information 104*c* is in the tube liquid passage F2 (S7: NO), the CPU 101 at S72 sets the purging amount in each of the regular suction purging and the regular air-discharge purging to a fixed purging amount (that is not zero and not changed depending upon the position of the flowed-in air which is indicated by the air-position information 104*c*), and when the CPU 101 at S7 determines that the position of the flowed-in air which is indicated by the air-position information 104*c* is in the supply liquid passage F3 (S7: YES), the CPU 101 at S71 sets the purging amount in each of the regular suction purging and the regular air-discharge purging to zero. Also in this modification, the purging amount is smaller when the air is located in the supply liquid passage F3 than when the air is located in the tube liquid passage F2.

In the purging-amount setting processing, the purging amount in each of the regular suction purging and the regular air-discharge purging may be made smaller when the position of air which is indicated by the air-position information 104*c* is located in the internal passage F1 than when the position of air which is indicated by the air-position information 104*c* is located in the tube liquid passages F2. Also, the determination of whether the purging-amount setting processing is to be executed is made based on the number of printed pages within the past one month in the above described embodiments, but the present disclosure is not limited to this processing. The determination of whether the purging-amount setting processing is to be executed may be made in any manner as long as the determination is based on a situation of execution of the print processing. For example, the determination of whether the purging-amount setting processing is to be executed may be made based on a total number of the print instructions within the past one month or a total amount of the ink ejected in the print processing or processings within the past one month.

When a print instruction is received in the state in which the maintenance change flag 104*f* is in the ON state, the CPU 101 may always control the purging device 9 to perform the printing air-discharge purging before executing the print processing. The air-discharge condition may not contain the condition that the volume of the flowed-in air which is indicated by the air-volume information 104*b* is greater than or equal to the threshold value. Also, the purging amount in the printing air-discharge purging may be fixed regardless of the volume of the flowed-in air which is indicated by the air-volume information 104*b*.

The air-discharge passages 74 for the air-discharge purging are not essential. In the case where the air-discharge passages 74 are removed, all the air existing in the damper chambers 71 and so on needs to be removed only in the suction purging from the nozzles 44 defined at the distal ends of the ink passages F5. The ink discharge operation performed by the purging device 9 is the suction purging for applying a suction force to the nozzles 44 in the above-described embodiments, but the present disclosure is not limited to this configuration. For example, the ink discharge operation may be pressure purging in which a pressure pump provided at a midway portion of the ink-supply tube 22 is driven to supply the ink to the head unit 5 to discharge the ink from the nozzles 44. The purging device may be capable of performing both of the suction purging and the pressure purging.

In the above-described embodiments, the ink is supplied to the ink passage F5 from the ink cartridge 42 removably mounted on the cartridge holder 6. However, the present disclosure is not limited to this configuration. For example, the printer 1 may be configured such that a tank provided in the printer 1 is connected to the ink passage F5, and the ink is supplied from this tank. In this case, when the tank becomes empty of the ink, the user inserts a bottle containing the ink, into a refill opening formed in the tank, thereby refilling the tank with the ink. When the tank is refilled with the ink, there is a possibility that air enters the ink passage F5.

In the above-described embodiments, the first-liquid-passage member is the ink-supply tube 22, and the second-liquid-passage member is the sub-tank 14 formed of resin and a film, that is, the first-liquid-passage member and the second-liquid-passage member are made of different materials. However, the printer 1 may be configured such that the first-liquid-passage member and the second-liquid-passage member are formed of the same material, and the thicknesses of the outer walls defining the liquid passages are different from each other, whereby the gas permeability is different between the first-liquid-passage member and the second-liquid-passage member. For example, in the case where the first-liquid-passage member is a liquid-passage defining member that needs to be deformed with movement of the carriage 3, the thickness of the outer wall of the first-liquid-passage member needs to be small for reducing its stiffness. On the other hand, in the case where the second-liquid-passage member does not need to be deformed with movement of the carriage 3, the thickness of the outer wall of the second-liquid-passage member does not need to be small. Accordingly, the gas permeability may be made different between the first-liquid-passage member and the second-liquid-passage member by making the thickness of the outer wall of the first-liquid-passage member smaller than the thickness of the outer wall of the second-liquid-passage member.

The CPU 101 in the air-position obtaining processing refers to the total-amount counter 104*a* and the air-volume information 104*b* to obtain the air-position information about the position of the flowed-in air in the above-described embodiments but may refer to only the total-amount counter 104*a* to obtain the air-position information. Also, the air-position information obtained in the air-position obtaining processing may not information directly indicating the position of the flowed-in air and may be information indirectly indicating the position of the flowed-in air, such as the total-amount count value of the total-amount counter 104*a*. Also, the printer 1 may further include a detector, such as an optical sensor, configured to detect air at a predetermined position in the ink passage F5 as a detecting position, and obtain the position of the flowed-in air based on a detection signal output from the optical sensor. Also, the printer 1 may be configured to obtain the position of the flowed-in air based on the total-amount counter 104*a* and the detection signal output from the optical sensor. In the air-volume calculating processing, the CPU 101 may calculate the volume of the flowed-in air with consideration of only increase in the size of air remaining in the first-liquid-passage member in which the degree of increase in the size of air is high.

The present disclosure may be applied to ink-jet printers of what is called a line type which record an image on a sheet conveyed by a conveying mechanism in a state in which an ink-jet head is fixed. The present disclosure is applied to the ink-jet printer configured to eject the ink onto the sheet to record an image in the above-described embodiments but may be applied to liquid ejection apparatuses used for operations other than the image recording.

What is claimed is:

1. A liquid ejection apparatus, comprising:

a head having a plurality of nozzles, the head being configured to eject liquid through the plurality of nozzles;

a first-liquid-passage member defining a first liquid passage that is a portion of a liquid passage connecting the head and a tank to each other, the tank being configured to store the liquid;

a second-liquid-passage member defining a second liquid passage that is another portion of the liquid passage which is different from the portion of the liquid passage as the first liquid passage, a gas permeability of the second-liquid-passage member being less than that of the first-liquid-passage member;

a purging device configured to perform a liquid purging operation to forcibly discharge the liquid from the plurality of nozzles; and a controller configured to:

obtain air-position information as positional information relating to a position of air having flowed into the liquid passage from a liquid inlet opening that is one end of the liquid passage which is nearer to the tank than another end of the liquid passage; and execute a liquid discharge processing in which the controller controls the purging device to execute the liquid purging operation such that an amount of the liquid discharged in the liquid purging operation performed when the position of the air which is indicated by the air-position information is located in the second liquid passage is less than an amount of the liquid discharged in the liquid purging operation performed when the position of the air which is indicated by the air-position information is located in the first liquid passage.

2. The liquid ejection apparatus according to claim 1, wherein the controller is configured to execute the liquid discharge processing each time when a first period is elapsed.

3. The liquid ejection apparatus according to claim 2, wherein the controller is configured to, when the first period is elapsed from a preceding liquid discharge processing and when the position of the air which is indicated by the air-position information is located in the second liquid passage, determine an amount of the liquid discharged in a current liquid discharge processing, to zero.

4. The liquid ejection apparatus according to claim 3, wherein the controller is configured to control the purging device to discharge the liquid in the current liquid discharge processing when the first period is elapsed from the preceding liquid discharge processing and when the position of the air which is indicated by the air-position information is located in the first liquid passage, and wherein the controller is configured not to cause the purging device to discharge the liquid in the current liquid discharge processing when the first period is elapsed from the preceding liquid discharge processing and when the position of the air which is indicated by the air-position information is located in the second liquid passage.

5. The liquid ejection apparatus according to claim 1, wherein the controller is configured to execute:

a print processing in which the controller controls the head to eject the liquid from the plurality of nozzles toward a recording medium to print an image on the recording medium; and a determination processing in which the controller determines a purging processing to be executed, to one of a first purging processing and a second purging processing based on a situation of execution of the print processing, wherein the first purging processing is a processing in which the controller controls the purging device to discharge the liquid with an amount that does not change depending upon the position of the air which is indicated by the air-position information, wherein the second purging processing is a processing in which an amount of the liquid discharged when the position of the air which is indicated by the air-position information is located in the second liquid passage is less than an amount of the liquid discharged when the position of the air which is indicated by the air-position information is located in the first liquid passage, and wherein the controller is configured to, when the position of the air which is indicated by the air-position information is located in the second liquid passage, control the purging device to perform the liquid purging operation by executing one of the first purging processing and the second purging processing, which one is determined in the determination processing based on the situation of execution of the print processing.

6. The liquid ejection apparatus according to claim 5, wherein the controller is configured to, in the determination processing, determine the purging processing to be executed, to the second purging processing when the number of recording media printed in the print processing within a latest particular period is less than a particular number, and wherein the controller is configured to, in the determination processing, determine the purging processing to be executed, to the first purging processing when the number of recording media printed in the print processing within the latest particular period is greater than or equal to the particular number.

7. The liquid ejection apparatus according to claim 6, wherein the controller is configured to execute:

a print processing in which the controller controls the head to eject the liquid from the plurality of nozzles toward a recording medium to print an image on the recording medium; and a before-printing discharge processing after reception of a print instruction for instructing execution of the print processing and before printing of the image onto the recording medium based on the print instruction, the controller being configured to, in the before-printing discharge processing, control the head to perform forcible discharge of the liquid from the plurality of nozzles, the forcible discharge being different from ejection of the liquid toward the recording medium, and wherein the controller is configured to: obtain the air-position information at each of a timing after reception of the print instruction and before the before-printing discharge processing and a timing after the before-printing discharge processing and before the print processing; and control the purging device to perform the air-discharge purging operation when at least a condition that the position of the air which is indicated by the air-position information is located in the air-storage chamber is satisfied.

8. The liquid ejection apparatus according to claim 1, further comprising:

a liquid passage definer comprising the first-liquid-passage member, the second-liquid-passage member, and an air-storage chamber configured to temporarily store the air and located nearer to the head than the first liquid passage and the second liquid passage; and an air-discharge passage extending from an inside of the air-storage chamber to an outside, wherein the purging device is configured to perform an air-discharge purging operation to discharge the air from the air-storage chamber to the outside via the air-discharge passage, and wherein the controller is configured to control the purging device to perform the air-discharge purging operation when at least a condition that the position of the air which is indicated by the air-position information is located in the air-storage chamber is satisfied.

9. The liquid ejection apparatus according to claim 8, wherein the controller is configured to determine a length of time in which the air is located in the first liquid passage and a length of time in which the air is located in the second liquid passage, based on the position of the air which is indicated by the air-position information, wherein the controller is configured to determine air-volume information based on the length of time in which the air is located in the first liquid passage, the length of time in which the air is located in the second liquid passage, the gas permeability of the first-liquid-passage member, and the gas permeability of the second-liquid-passage member, and the air-volume information indicates a volume of the air in the liquid passage, and wherein the controller is configured to control the purging device to perform the air-discharge purging operation when at least a condition that the volume of the air which is indicated by the air-volume information is greater than or equal to a particular value is satisfied.

10. The liquid ejection apparatus according to claim 9, wherein the controller is configured to determine a length of time in which the air is located in the first liquid passage and a length of time in which the air is located in the second liquid passage, based on the position of the air which is indicated by the air-position information, wherein the controller is configured to determine air-volume information based on the length of time in which the air is located in the first liquid passage, the length of time in which the air is located in the second liquid passage, the gas permeability of the first-liquid-passage member, and the gas permeability of the second-liquid-passage member, and the air-volume information indicates a volume of the air in the liquid passage, and wherein the controller is configured to control the purging device such that an amount of the liquid discharged to the outside in the air-discharge purging operation increases with increase in the volume of the air which is indicated by the air-volume information.

11. The liquid ejection apparatus according to claim 1, wherein the controller is configured to execute:

a print processing in which the controller controls the head to eject the liquid from the plurality of nozzles toward a recording medium to print an image on the recording medium; and a before-printing discharge processing after reception of a print instruction for instructing execution of the print processing and before printing of the image onto the recording medium based on the print instruction, the controller being configured to, in the before-printing discharge processing, control the head to perform forcible discharge of the liquid from the plurality of nozzles, the forcible discharge being different from ejection of the liquid toward the recording medium, and wherein the controller is configured to execute the before-printing discharge processing in response to reception of the print instruction when the liquid has already been forcibly discharged in the liquid discharge processing at the reception of the print instruction with an amount made smaller based on the air-position information.

12. The liquid ejection apparatus according to claim 1, further comprising a tank mount on which the tank is to be removably mounted, the tank mount comprising the liquid inlet opening that is connected to the tank when the tank is mounted on the tank mount, wherein the controller is configured to:

determine a total amount that is a sum of an amount of the liquid ejected from the plurality of nozzles and an amount of the liquid forcibly discharged from the plurality of nozzles in the liquid purging operation performed by the purging device, the total amount being calculated from a time point of reception of a signal indicating that the tank is mounted on the tank mount; and obtain, using the determined total amount, the air-position information indicating the position of the air having flowed from the liquid inlet opening into the liquid passage when the tank and the liquid inlet opening are connected to each other.

13. The liquid ejection apparatus according to claim 12, wherein the controller is configured to:

based on the air-position information obtained using the total amount, obtain a length of time for which the air is located in the first liquid passage and a length of time for which the air is located in the second liquid passage;

determine a volume of the air in the liquid passage based on the obtained length of time for which the air is located in the first liquid passage, the obtained length of time for which the air is located in the second liquid passage, the gas permeability of the first-liquid-passage member, and the gas permeability of the second-liquid-passage member; and based on the total amount and the determined volume of the air, obtain one end portion of the air in the liquid passage as the position of the air, which one end portion is nearer to the tank than another end portion of the air in the liquid passage.

14. The liquid ejection apparatus according to claim 1, wherein the first-liquid-passage member is a tube, and wherein the second-liquid-passage member is constituted by a film and a resin member, and a gas permeability of each of the film and the resin member is less than that of the tube.

15. A liquid ejection apparatus, comprising:

a head having a plurality of nozzles, the head being configured to eject liquid through the plurality of nozzles;

a liquid passage definer defining (a) a liquid passage connecting between the head and a tank configured to store the liquid and (b) an air-discharge passage extending to an outside by branching off from a branch position located at a portion of the liquid passage, the liquid passage definer comprising (i) a first-liquid-passage member defining a first liquid passage that is a portion of the liquid passage and that is located nearer to the tank than the branch position and (ii) a second-liquid-passage member defining a second liquid passage that is located nearer to the tank than the branch position and that is another portion of the liquid passage which is different from the portion of the liquid passage as the first liquid passage, a gas permeability of the second-liquid-passage member being less than that of the first-liquid-passage member;

a purging device configured to perform an air-discharge purging operation to discharge air from the liquid passage to the outside via the air-discharge passage; and a controller configured to:

obtain air-position information as positional information relating to a position of the air having flowed into the liquid passage from a liquid inlet opening that is one end of the liquid passage which is nearer to the tank than another end of the liquid passage; and execute a liquid discharge processing in which the controller controls the purging device to execute the air-discharge purging operation such that an amount of the air discharged from the liquid passage in the air-discharge purging operation performed when the position of the air which is indicated by the air-position information is located in the second liquid passage is less than an amount of the air discharged from the liquid passage in the air-discharge purging operation performed when the position of the air which is indicated by the air-position information is located in the first liquid passage.

16. A liquid ejection apparatus, comprising:

a head having a plurality of nozzles, the head being configured to eject liquid through the plurality of nozzles;

a first-liquid-passage member defining a first liquid passage that is a portion of a liquid passage connecting the head and a tank to each other, the tank being configured to store the liquid;

a second-liquid-passage member defining a second liquid passage that is another portion of the liquid passage which is different from the portion of the liquid passage as the first liquid passage, a gas permeability of the second-liquid-passage member being less than that of the first-liquid-passage member;

a purging device configured to perform a liquid purging operation to forcibly discharge the liquid from the plurality of nozzles; and a controller configured to:

obtain air-position information as positional information relating to a position of air having flowed into the liquid passage from a liquid inlet opening that is one end of the liquid passage which is nearer to the tank than another end of the liquid passage; and execute a liquid discharge processing in which the controller controls the purging device to execute the liquid purging operation such that an interval at which the liquid purging operation is performed when the position of the air which is indicated by the air-position information is located in the second liquid passage is greater than an interval at which the liquid purging operation is performed when the position of the air which is indicated by the air-position information is located in the first liquid passage.

17. A liquid ejection apparatus, comprising:

a head having a plurality of nozzles, the head being configured to eject liquid through the plurality of nozzles;

a liquid passage definer defining (a) a liquid passage connecting between the head and a tank configured to store the liquid and (b) an air-discharge passage extending to an outside by branching off from a branch position located at a portion of the liquid passage, the liquid passage definer comprising (i) a first-liquid-passage member defining a first liquid passage that is a portion of the liquid passage and that is located nearer to the tank than the branch position and (ii) a second-liquid-passage member defining a second liquid passage that is located nearer to the tank than the branch position and that is another portion of the liquid passage which is different from the portion of the liquid passage as the first liquid passage, a gas permeability of the second-liquid-passage member being less than that of the first-liquid-passage member;

a purging device configured to perform an air-discharge purging operation to discharge air from the liquid passage to the outside via the air-discharge passage; and a controller configured to:

obtain air-position information as positional information relating to a position of the air having flowed into the liquid passage from a liquid inlet opening that is one end of the liquid passage which is nearer to the tank than another end of the liquid passage; and execute a liquid discharge processing in which the controller controls the purging device to execute the air-discharge purging operation such that an interval at which the air-discharge purging operation is performed when the position of the air which is indicated by the air-position information is located in the second liquid passage is greater than an interval at which the air-discharge purging operation is performed when the position of the air which is indicated by the air-position information is located in the first liquid passage.

18. A liquid ejection apparatus, comprising:

a head having a plurality of nozzles, the head being configured to eject liquid through the plurality of nozzles;

a first-liquid-passage member defining a first liquid passage that is a portion of a liquid passage connecting the head and a tank to each other, the tank being configured to store the liquid;

a second-liquid-passage member defining a second liquid passage that is another portion of the liquid passage which is different from the portion of the liquid passage as the first liquid passage, a gas permeability of the second-liquid-passage member being less than that of the first-liquid-passage member; and a controller configured to:

control the head to perform a flushing operation to discharge the liquid from the plurality of nozzles;

obtain air-position information as positional information relating to a position of air having flowed into the liquid passage from a liquid inlet opening that is one end of the liquid passage which is nearer to the tank than another end of the liquid passage; and set an amount of the liquid discharged in the flushing operation performed when the position of the air which is indicated by the air-position information is located in the second liquid passage, to value less than an amount of the liquid discharged in the flushing operation performed when the position of the air which is indicated by the air-position information is located in the first liquid passage.

* * * * *